US011367955B2

(12) United States Patent
Takaki et al.

(10) Patent No.: US 11,367,955 B2
(45) Date of Patent: Jun. 21, 2022

(54) MULTI-BAND ANTENNA AND METHOD FOR DESIGNING MULTI-BAND ANTENNA

(71) Applicant: MURATA MANUFACTURING CO., LTD., Nagaokakyo (JP)

(72) Inventors: Yasunori Takaki, Tokyo (JP); Masato Enoki, Tokyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 11 days.

(21) Appl. No.: 16/984,541

(22) Filed: Aug. 4, 2020

(65) Prior Publication Data

US 2021/0044018 A1 Feb. 11, 2021

(30) Foreign Application Priority Data

Aug. 7, 2019 (JP) ..... JP2019-145706

(51) Int. Cl.
*H01Q 5/307* (2015.01)
*H01Q 9/04* (2006.01)
*H01Q 1/48* (2006.01)

(52) U.S. Cl.
CPC ..... *H01Q 5/307* (2015.01); *H01Q 1/48* (2013.01); *H01Q 9/0407* (2013.01); *H01Q 9/0414* (2013.01)

(58) Field of Classification Search
CPC .... H01Q 5/307; H01Q 9/0414; H01Q 9/0407; H01Q 1/48; H01Q 21/24; H01Q 21/065;
(Continued)

(56) References Cited

U.S. PATENT DOCUMENTS

2015/0054706 A1 2/2015 Shinura et al.
2019/0027802 A1* 1/2019 Noori ..... H01Q 3/30
(Continued)

FOREIGN PATENT DOCUMENTS

JP 2015-062276 4/2015

OTHER PUBLICATIONS

Cho et al. "Front-to-Back Ratio Improvement of a Microstrip Patch antenna by Ground Plane Edge Shaping", 2010, Kyonggi University, 4 pages. (Year: 2010).*

*Primary Examiner* — Daniel D Chang
(74) *Attorney, Agent, or Firm* — Nixon Peabody LLP; Jeffrey L. Costellia

(57) ABSTRACT

A multi-band antenna is capable of transmitting/receiving electromagnetic waves at least in a first wavelength band of a first center wavelength λ1 and a second wavelength band of a second center wavelength λ2, which is shorter than the first center wavelength λ1, the multi-band antenna including at least one antenna unit, wherein the at least one antenna unit includes: a first radiation conductor; and a first ground conductor spaced apart from the first radiation conductor with a dielectric having a relative dielectric constant εr interposed therebetween, wherein: the first radiation conductor and the first ground conductor each have a planar shape having a pair of opposing first sides; and a distance Lrf1 between the pair of opposing first sides of the first radiation conductor and a distance Lg1 between the pair of opposing sides of the first ground conductor satisfy expressions below:

$$0.2\lambda 1/\varepsilon r^{1/2} \leq Lrf1 \leq 0.7\lambda 1/\varepsilon r^{1/2}; \text{ and}$$

$$0.7\lambda 2/\varepsilon r^{1/2} \leq Lg1 \leq 1.75\lambda 2/\varepsilon r^{1/2}.$$

16 Claims, 15 Drawing Sheets

(58) Field of Classification Search
CPC ..... H01Q 5/342; H01Q 5/35; H01Q 3/24; H01Q 21/28; H01Q 1/2283; H01Q 9/0457; H01Q 1/243; H01Q 1/36; H01Q 1/50; H01Q 5/30; H01Q 5/50
See application file for complete search history.

(56) References Cited

U.S. PATENT DOCUMENTS

| | | | | |
|---|---|---|---|---|
| 2020/0203851 | A1* | 6/2020 | Takaki | H01Q 9/0457 |
| 2020/0287298 | A1* | 9/2020 | Ueda | H01Q 9/0407 |

* cited by examiner

MULTI-BAND ANTENNA AND METHOD FOR DESIGNING MULTI-BAND ANTENNA

BACKGROUND

1. Technical Field

The present application relates to a multi-band antenna and a method for designing such a multi-band antenna.

2. Description of the Related Art

With the increasing use of Internet communication and the developments made in high-quality video technology and IoT technology, higher connection speeds are wanted for wireless communication, and there is a demand for high-frequency wireless communication technologies capable of transmitting/receiving larger amounts of information. Different countries/regions often use different frequency bands for wireless communication, and there is a demand for wireless communication devices capable of handling different frequency bands in order to reduce cost for wireless communication devices. There is also a demand for wireless communication devices that are capable of transmitting larger amounts of information by simultaneously using radio waves of different frequency bands.

Such a wireless communication device uses a multi-band antenna capable of transmitting/receiving radio waves of different frequency bands. For example, Japanese Laid-Open Patent Publication No. 2015-062276 discloses a multi-band antenna that can achieve a reduction in size while maintaining its antenna capabilities.

SUMMARY

The present application provides a multi-band antenna with which it is easy to adjust the frequency band used, and a method for designing such a multi-band antenna.

A multi-band antenna of the present disclosure is a multi-band antenna capable of transmitting/receiving electromagnetic waves at least in a first wavelength band of a first center wavelength λ1 and a second wavelength band of a second center wavelength λ2, which is shorter than the first center wavelength λ1, the multi-band antenna including at least one antenna unit, wherein the at least one antenna unit includes: a first radiation conductor; and a first ground conductor spaced apart from the first radiation conductor with a dielectric having a relative dielectric constant sr interposed therebetween, wherein: the first radiation conductor and the first ground conductor each have a planar shape having a pair of opposing first sides; and a distance Lrf1 between the pair of opposing first sides of the first radiation conductor and a distance Lg1 between the pair of opposing sides of the first ground conductor satisfy expressions below:

$$0.2\lambda 1/\varepsilon r^{1/2} \leq Lrf1 \leq 0.7\lambda 1/\varepsilon r^{1/2}; \text{ and}$$

$$0.7\lambda 2/\varepsilon r^{1/2} \leq Lg1 \leq 1.75\lambda 2/\varepsilon r^{1/2}.$$

In one embodiment, the at least one antenna unit further includes a second radiation conductor arranged between the first radiation conductor and the first ground conductor.

In one embodiment, the second radiation conductor has a planar shape having a pair of opposing first sides; a distance Lrs1 between the pair of opposing sides of the second radiation conductor satisfies an expression below:

$$0.2\lambda 1/\varepsilon r^{1/2} \leq Lrs1 \leq 0.5\lambda 1/\varepsilon r^{1/2}.$$

In one embodiment, the multi-band antenna further includes a first strip conductor arranged between the first radiation conductor or the second radiation conductor and the first ground conductor for feeding the first and second radiation conductors.

In one embodiment, the multi-band antenna further includes: a second strip conductor arranged between the first radiation conductor or the second radiation conductor and the first ground conductor for feeding the first and second radiation conductors, wherein the first strip conductor and the second strip conductor extend in directions that are orthogonal to each other.

In one embodiment, the at least one antenna unit further includes a second ground conductor arranged on an opposite side from the first radiation conductor relative to the first ground conductor, wherein the second ground conductor has an outer edge that surrounds the first ground conductor as seen from above.

In one embodiment, the first ground conductor and the second ground conductor are electrically connected to each other.

In one embodiment, the at least one antenna unit includes: a hole provided in the second ground conductor; a feed conductor extending through the hole of the second ground conductor and having one end connected to the first strip conductor; and a plurality of first via conductors arranged so as to sandwich or surround the feed conductor as seen from above, wherein the first via conductors connect together the first ground conductor and the second ground conductor.

In one embodiment, the at least one antenna unit includes a plurality of second via conductors that connect together the first ground conductor and the second ground conductor; and the plurality of second via conductors are arranged along at least a portion of a periphery of the first ground conductor and overlap with the first ground conductor as seen from above.

In one embodiment, the first radiation conductor has a rectangular shape having the pair of opposing first sides and the pair of opposing second sides; and a distance Lrf2 between the pair of opposing second sides of the first radiation conductor satisfies an expression below:

$$0.2\lambda 1/\varepsilon r^{1/2} \leq Lrf2 \leq 0.7\lambda 1/\varepsilon r^{1/2}.$$

In one embodiment, the second radiation conductor has a rectangular shape having the pair of opposing first sides and the pair of opposing second sides; and a distance Lrs2 between the pair of opposing second sides of the second radiation conductor satisfies an expression below:

$$0.2\lambda 1/\varepsilon r^{1/2} \leq Lrs2 \leq 0.7\lambda 1/\varepsilon r^{1/2}.$$

In one embodiment, the planar shape of the first ground conductor further has a pair of opposing second sides; and a distance Lg2 between the pair of opposing second sides of the first ground conductor satisfies an expression below:

$$0.7\lambda 2/\varepsilon r^{1/2} \leq Lg2 \leq 1.75\lambda 2/\varepsilon r^{1/2}.$$

In one embodiment, the multi-band antenna includes a plurality of antenna units, wherein the antenna units are arranged along a first direction.

In one embodiment, the multi-band antenna includes a plurality of antenna units, wherein: the antenna units are arranged along a first direction; and the second ground conductor of each of the antenna units is connected to the second ground conductor of an adjacent antenna unit.

In one embodiment, in each of the antenna units, the pair of first sides of the first radiation conductor and the pair of first sides of the first ground conductor are arranged at an angle of 45° or −45° relative to the first direction as seen from above.

In one embodiment, the first ground conductor of each of the antenna units is connected to the first ground conductor of an adjacent antenna unit.

In one embodiment, the first ground conductor of each of the antenna units is separate from the first ground conductor of an adjacent antenna unit.

A method for designing a multi-band antenna of the present disclosure is a method for designing a multi-band antenna capable of transmitting/receiving electromagnetic waves in a first wavelength band of a first center wavelength λ1 and a second wavelength band of a second center wavelength λ2, which is shorter than the first center wavelength λ1, the multi-band antenna including at least one antenna unit, wherein the at least one antenna unit includes: a radiation conductor; and a first ground conductor spaced apart from the first radiation conductor with a dielectric interposed therebetween, the method including: determining a size of the first radiation conductor based on the first center wavelength λ1; and determining a size of the first ground conductor based on the second center wavelength λ2.

In one embodiment, the first radiation conductor and the first ground conductor each have a planar shape having a pair of opposing first sides; and the method includes determining a distance Lrf1 between the pair of opposing first sides of the first radiation conductor and a distance Lg1 between the pair of opposing sides of the first ground conductor based on the first center wavelength λ1 and the second center wavelength λ2, respectively.

In one embodiment, the at least one antenna unit further includes a second radiation conductor arranged between the first radiation conductor and the first ground conductor; the second radiation conductor has a planar shape having a pair of opposing first sides; and the method includes determining a distance Lrs1 between the pair of opposing sides of the second radiation conductor based on the second center wavelength λ2.

The present disclosure provides a multi-band antenna with which it is easy to adjust the frequency band used, and a method for designing such a multi-band antenna.

DETAILED DESCRIPTION

Figure 1:
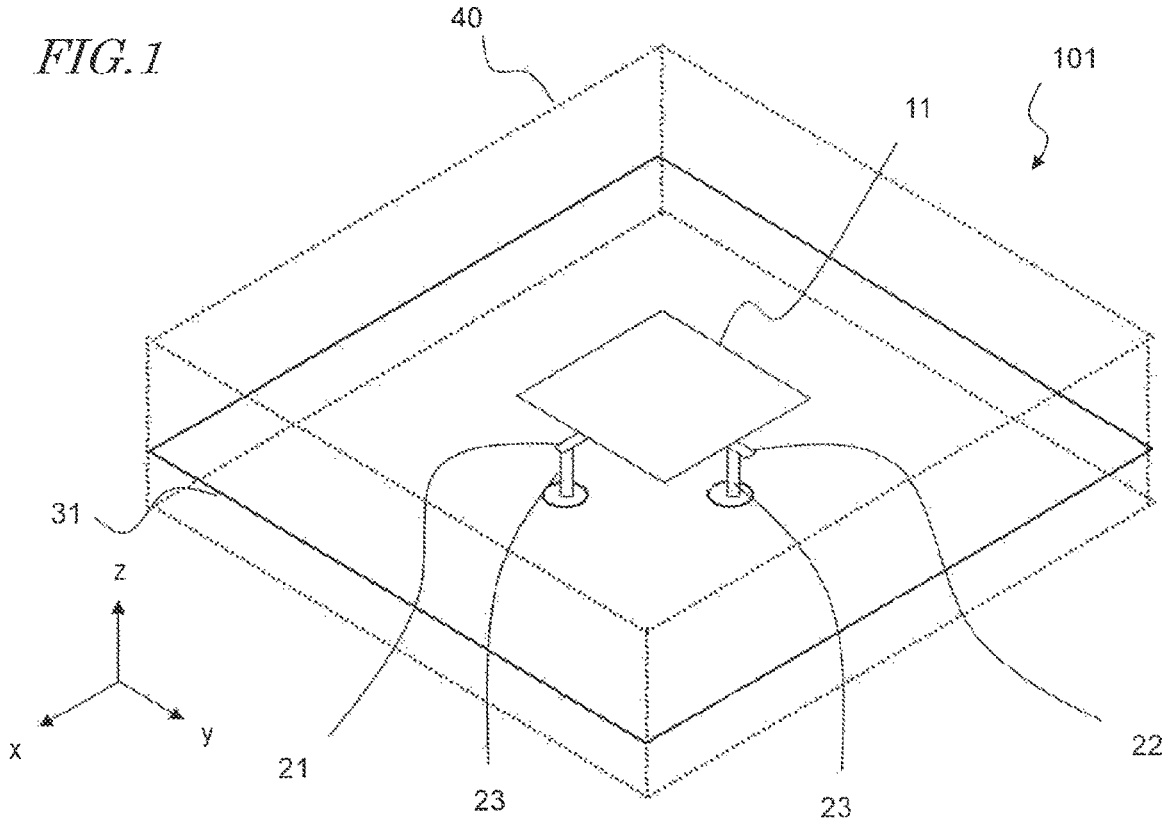
FIG. 1 is a perspective view showing an example multi-band antenna according to Embodiment 1.

A multi-band antenna and a method for designing a multi-band antenna of the present disclosure are applicable to wireless communication in quasi-microwave, centimeter wave, quasi-millimeter wave and millimeter wave bands, for example. Wireless communication in a quasi-microwave band uses, as the carrier wave, a radio wave having a wavelength of 10 cm to 30 cm and a frequency of 1 GHz to 3 GHz. Wireless communication in a centimeter wave band uses, as the carrier wave, a radio wave having a wavelength of 1 cm to 10 cm and a frequency of 3 GHz to 30 GHz. Wireless communication in a millimeter wave band uses, as the carrier wave, a radio wave having a wavelength of 1 mm to 10 mm and a frequency of 30 GHz to 300 GHz. Wireless communication in a quasi-millimeter wave band uses, as the carrier wave, a radio wave having a wavelength of 10 mm to 30 mm and a frequency of 10 GHz to 30 GHz. For wireless communication in these bands, the size of a planar antenna is on the order of centimeters to sub-millimeters. For example, where a multi-layer ceramic sintered substrate is used for a quasi-microwave, centimeter-wave, quasi-millimeter-wave or millimeter-wave wireless communication circuit, a multi-band antenna of the present disclosure can be mounted on the multi-layer ceramic sintered substrate.

In the present embodiment, unless otherwise noted, a multi-band antenna will be described below that is capable of transmitting/receiving electromagnetic waves in a first wavelength band of a first center wavelength λ1 and a second wavelength band of a second center wavelength λ2, which is shorter than the first center wavelength λ1, as an example carrier wave in the quasi-microwave, centimeter wave, quasi-millimeter wave or millimeter wave band. Specifically, the first wavelength band is 9.1 mm to 11.5 mm, which corresponds to a frequency range of 26 GHz to 33 GHz. The second wavelength band is 7.3 mm to 8.3 mm, which corresponds to a frequency range of 36 GHz to 41 GHz. The first wavelength band and the second wavelength band will be referred to also as the 28 GHz band and the 38 GHz band.

The present disclosure uses a right-handed Cartesian coordinate system for illustrating the arrangement, orientation, etc., of components. Specifically, the first right-handed Cartesian coordinate system has x, y and z axes, which are orthogonal to each other, and the second right-handed Cartesian coordinate system has u, v and w axes, which are orthogonal to each other. The axes are named x, y, z and u, v, w in order to distinguish between the first right-handed Cartesian coordinate system and the second right-handed Cartesian coordinate system and to specify the order of axes for each right-handed coordinate system. However, the axes may be referred to as a first, second and third axis.

As used herein, two directions being aligned with each other means that the angle formed between the two directions is generally in the range of 0° to about 20°. Preferably, the angle is in the range of 0° to about 10°. Being parallel herein means that the angle formed between two planes, between two straight lines or between a plane and a straight line is in the range of 0° to about 10°, more preferably in the range of 0° to about 5°. Where a direction is defined with reference to an axis, the + direction and the − direction of the axis with respect to a reference will be distinguished from each other if it is important to do so. A simple term "axis direction" will be used where it is only important to define which axis the direction extends along and it is not important to distinguish between the + direction and the − direction of the axis.

Embodiment 1

Figure 2:
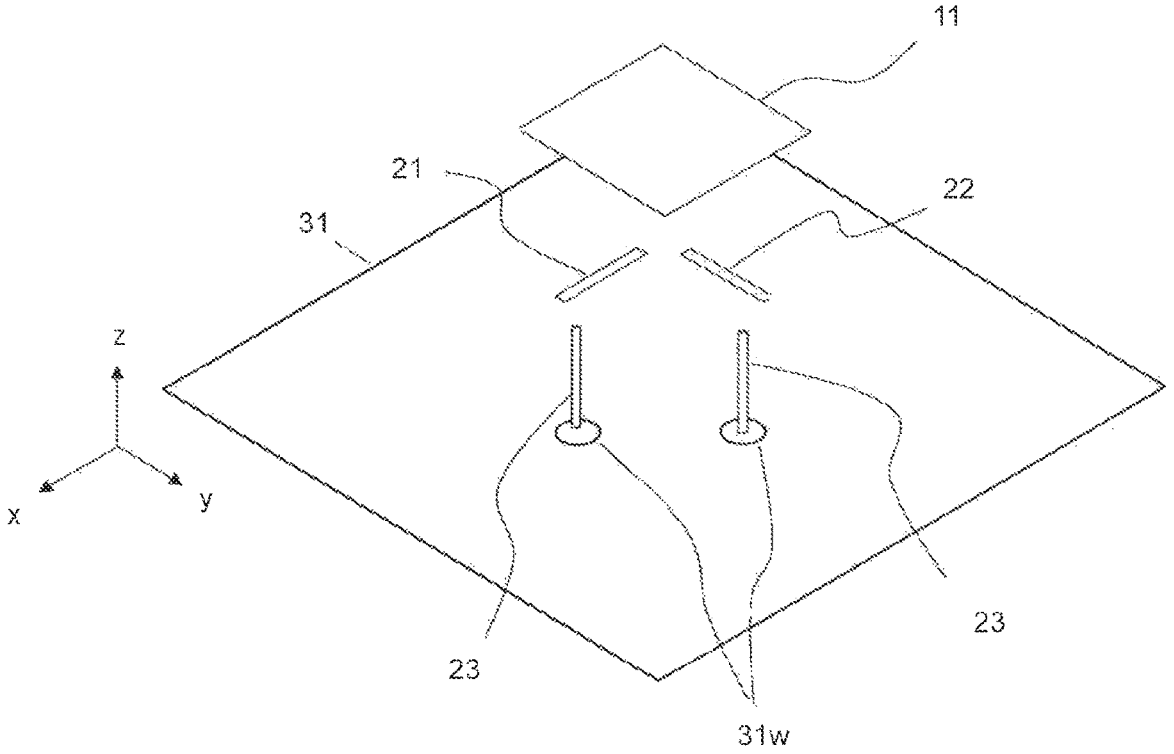
FIG. 2 is an exploded perspective view showing a part of the multi-band antenna of FIG. 1.
Figure 3:
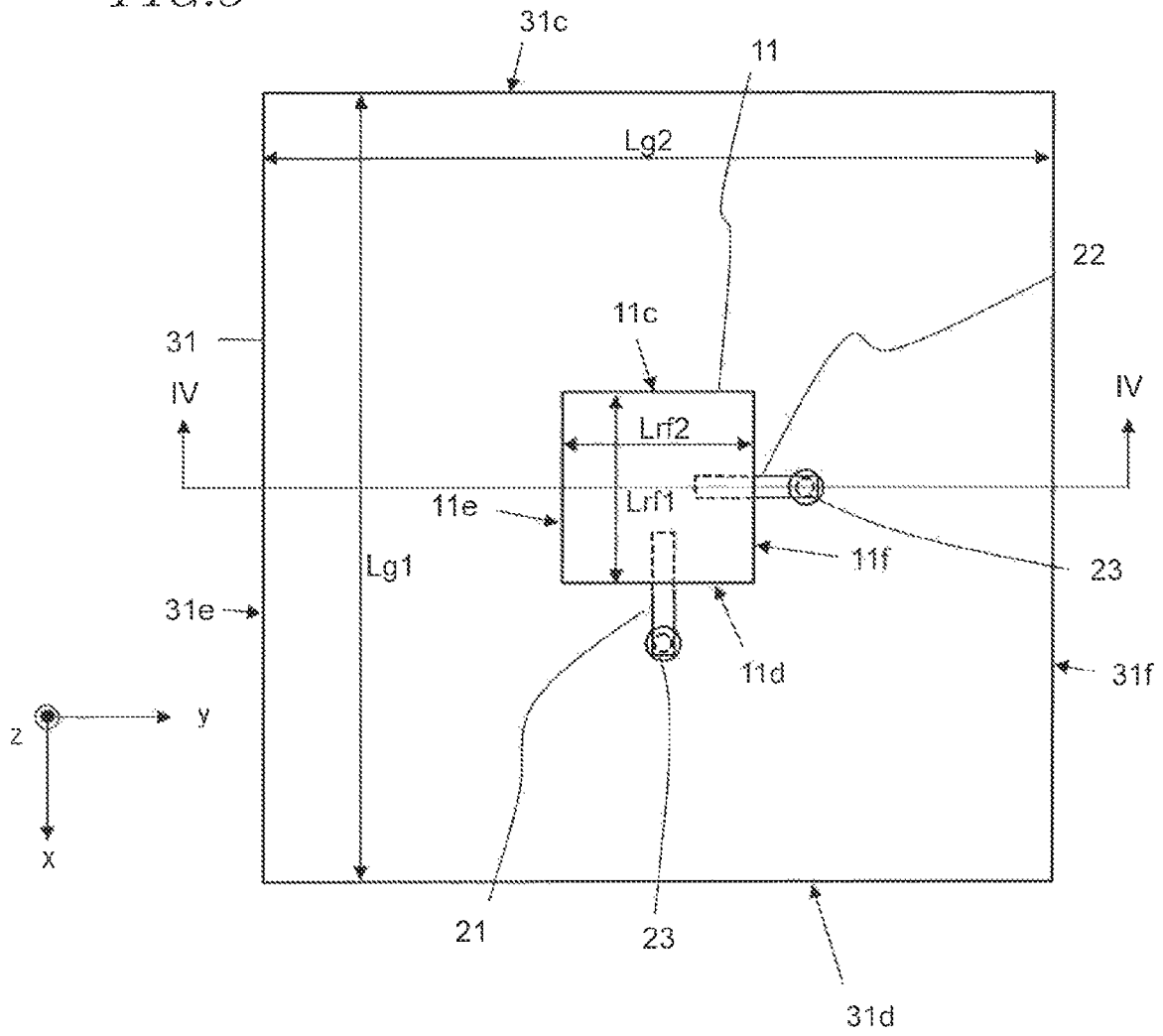
FIG. 3 is a plan view showing the multi-band antenna of FIG. 1.
Figure 4:
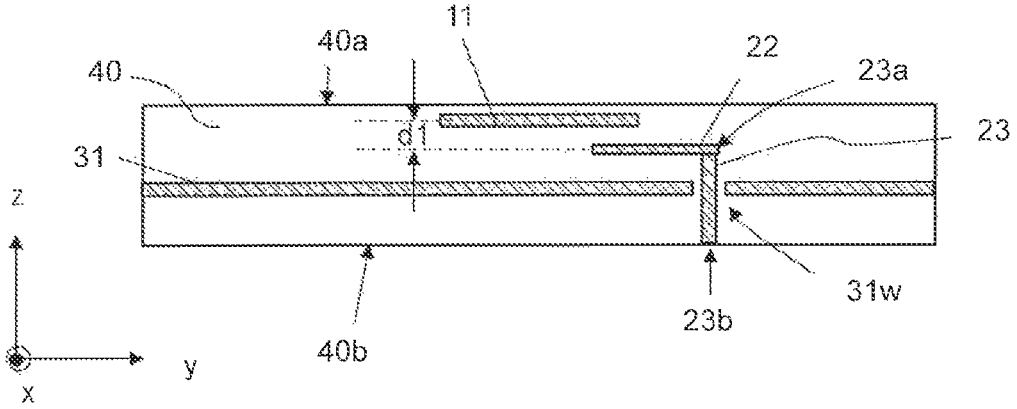
FIG. 4 is a cross-sectional view showing the multi-band antenna taken along line IV-IV of FIG. 3.

A multi-band antenna according to Embodiment 1 of the present disclosure will be described. FIG. 1 is a schematic perspective view showing a multi-band antenna 101 of the present disclosure. FIG. 2 is an exploded perspective view showing main components of the multi-band antenna 101. FIG. 3 is a plan view showing the multi-band antenna 101, and FIG. 4 is a cross-sectional view taken along IV-IV of FIG. 3.

The multi-band antenna 101 includes a first radiation conductor 11 and a first ground conductor 31. In the present embodiment, the multi-band antenna 101 includes a first strip conductor 21 and a second strip conductor 22 for feeding electric power to the first radiation conductor 11. As will be described below, the multi-band antenna 101 includes a dielectric 40.

The first radiation conductor 11 is a planar conductor arranged generally parallel to the xy plane. The first radiation conductor 11 is a radiation element that radiates radio waves, and is shaped so as to realize desired radiation characteristics and impedance match. The planar shape of the first radiation conductor 11 has at least a pair of opposing first sides 11*c* and 11*d*. In the present embodiment, the first radiation conductor 11 has a rectangular shape having two pairs of sides that are generally parallel to the x-axis direction and the y-axis direction, respectively. Specifically, the first radiation conductor 11 has a pair of opposing first sides 11*c* and 11*d* and a pair of opposing second sides 11*e* and 11*f*. The first sides 11*c* and 11*d* are preferably parallel to each other, and the second sides 11*e* and 11*f* are preferably parallel to each other. The first sides 11*c* and 11*d* and the second sides 11*e* and 11*f* are preferably orthogonal to each other.

Where sr is the relative dielectric constant of the dielectric 40 and power is fed simultaneously from the first strip conductor 21 and the second strip conductor 22, the distance Lrf1 between the pair of opposing first sides 11*c* and 11*d* satisfies Expression (1D) below.

$$0.2\lambda 1/\varepsilon r^{1/2} Lrf1 \leq 0.5\lambda 1/\varepsilon r^{1/2} \quad (1D)$$

Preferably, the distance Lrf2 between the pair of opposing second sides 11*e* and 11*f* satisfies Expression (2D) below.

$$0.2\lambda 1/\varepsilon r^{1/2} \leq Lrf2 \leq 0.5\lambda 1/\varepsilon r^{1/2} \quad (2D)$$

Lrf2 and Lrf1 may be equal to each other or may be different from each other. More preferably, Lrf1 and Lrf2 satisfy Expressions (1D') and (2D') below.

$$0.25\lambda 1/\varepsilon r^{1/2} \leq Lrf1 \leq 0.4\lambda 1/\varepsilon r^{1/2} \quad (1D')$$

$$0.25\lambda 1/\varepsilon r^{1/2} \leq Lrf2 \leq 0.4\lambda 1/\varepsilon r^{1/2} \quad (2D')$$

Where εr is the relative dielectric constant of the dielectric 40 and power is fed only from one of the first strip conductor 21 and the second strip conductor 22, the distance Lrf1 between the pair of opposing first sides 11*c* and 11*d* satisfies Expression (1b) below.

$$0.3\lambda 1/\varepsilon r^{1/2} \leq Lrf1 \leq 0.7\lambda 1/\varepsilon r^{1/2} \quad (1S)$$

Preferably, the distance Lrf2 between the pair of opposing second sides 11*e* and 11*f* satisfies Expression (2S) below.

$$0.3\lambda 1/\varepsilon r^{1/2} \leq Lrf2 \leq 0.7\lambda 1/\varepsilon r^{1/2} \quad (2S)$$

Lrf2 and Lrf1 may be equal to each other or may be different from each other. More preferably, Lrf1 and Lrf2 satisfy Expressions (1'b) and (2'b) below.

$$0.35\lambda 1/\varepsilon r^{1/2} \leq Lrf1 \leq 0.6\lambda 1/\varepsilon r^{1/2} \quad (1S')$$

$$0.35\lambda 1/\varepsilon r^{1/2} \leq Lrf2 \leq 0.6\lambda 1/\varepsilon r^{1/2} \quad (2S')$$

Lrf1 and Lrf2 of the first radiation conductor 11 are determined so that the radiated electromagnetic wave of the first center wavelength λ1 resonates under the condition of (λ1)/2. Thus, the resonance frequency shifts in accordance with the lengths Lrf1 and Lrf2. That is, the electromagnetic wave of the first wavelength band can be adjusted based on the lengths Lrf1 and Lrf2.

The distribution direction of the excited electromagnetic wave varies depending on whether the signal power is fed simultaneously to the first strip conductor 21 and the second strip conductor 22 or the signal power is fed to only one of them. Where the signal power is fed to only one of the first strip conductor 21 and the second strip conductor 22, the electromagnetic wave is distributed in the direction perpendicular to the first sides 11*c* and 11*d* or the second sides 11*e* and 11*f*. Therefore, the resonance frequency of the electromagnetic wave is determined so that the first sides 11*c* and 11*d* or the second sides 11*e* and 11*f* are positioned at the node of the electromagnetic wave. In contrast, where the signal power is fed simultaneously to the first strip conductor 21 and the second strip conductor 22, the electromagnetic wave is distributed in the direction along the diagonal of the first radiation conductor 11. Therefore, the resonance frequency of the electromagnetic wave is determined so that a pair of vertexes arranged along the diagonal of the first radiation conductor 11 are positioned at the node of the electromagnetic wave.

On the other hand, Lrf1 and Lrf2 do not satisfy the resonance condition for the electromagnetic wave of the second center wavelength λ2. Therefore, the characteristics of the electromagnetic wave of the second wavelength band do not change substantially when the lengths Lrf1 and Lrf2 change.

As described above, the first sides 11*c* and 11*d* and the second sides 11*e* and 11*f* preferably have sufficient lengths to accommodate the spread of the electromagnetic wave since they are positioned at the node of the electromagnetic wave. When the first radiation conductor 11 has a rectangular shape, the length of the first sides 11*c* and 11*d* is equal to Lrf2, which is the distance between the second sides 11*e* and 11*f*, and the length of the second sides 11*e* and 11*f* is equal to Lrf1, which is the distance between the first sides 11*c* and 11*d*.

The first ground conductor 31 is a planar conductor arranged generally parallel to the xy plane and spaced apart from the first radiation conductor 11 in the z-axis direction with the dielectric 40 interposed therebetween. The first ground conductor 31 adjusts the distribution of the electromagnetic wave radiated from the first radiation conductor 11. As seen from above (as seen in the z-axis direction), the first ground conductor 31 is larger than the first radiation conductor 11, and the outer edge of the first ground conductor 31 surrounds the outside of the first radiation conductor 11.

The first ground conductor 31 has a planar shape having at least a pair of first sides 31*c* and 31*d*. In the present embodiment, the first ground conductor 31 has a rectangular shape having two pairs of sides that are generally parallel to the x-axis direction and the y-axis direction, respectively. Specifically, the first ground conductor 31 has a pair of opposing first sides 31*c* and 31*d* and a pair of opposing second sides 31*e* and 31*f*. The first sides 31*c* and 31*d* are preferably parallel to each other, and the second sides 31*e* and 31*f* are preferably parallel to each other. The first sides 31*c* and 31*d* and the second sides 31*e* and 31*f* are preferably orthogonal to each other.

Where power is fed simultaneously from the first strip conductor 21 and the second strip conductor 22, the distance Lg1 between the pair of opposing first sides 31*c* and 31*d* satisfies Expression (3D) below.

$$0.7\lambda 2/\varepsilon r^{1/2} \leq Lg1 \leq 1.25\lambda 2/\varepsilon r^{1/2} \quad (3D)$$

Preferably, the distance Lg2 between the pair of opposing the second sides 31*e* and 31*f* satisfies Expression (4D) below.

$$0.7\lambda 2/\varepsilon r^{1/2} \leq Lg2 \leq 1.25\lambda 2/\varepsilon r^{1/2} \quad (4D)$$

Lg2 and Lg1 may be equal to each other or may be different from each other. More preferably, Lg1 and Lg2 satisfy Expressions (3') and (4') below, respectively.

$$0.8\lambda 2/\varepsilon r^{1/2} \leq Lg1 \leq 1.1\lambda 2/\varepsilon r^{1/2} \quad (3D')$$

$$0.8\lambda 2/\varepsilon r^{1/2} \leq Lg2 \leq 1.1\lambda 2/\varepsilon r^{1/2} \quad (4D')$$

Where power is fed from only one of the first strip conductor 21 or the second strip conductor 22, the distance Lg1 between the pair of opposing first sides 31*c* and 31*d* satisfies Expression (3S) below.

$$1\lambda 2/\varepsilon r^{1/2} \leq Lg1 \leq 1.75\lambda 2/\varepsilon r^{1/2} \quad (3S)$$

Preferably, the distance Lg2 between the pair of opposing second sides 31*e* and 31*f* satisfies Expression (4S) below.

$$1\lambda 2/\varepsilon r^{1/2} \leq Lg2 \leq 1.75\lambda 2/\varepsilon r^{1/2} \quad (4S)$$

Lg2 and Lg1 may be equal to each other or may be different from each other. More preferably, Lg1 and Lg2 satisfy Expressions (3'b) and (4'b) below, respectively.

$$1.1\lambda 2/\varepsilon r^{1/2} \leq Lg1 \leq 1.55 \leq 2/\varepsilon r^{1/2} \quad (3S')$$

$$1.1\lambda 2/\varepsilon r^{1/2} \leq Lg2 \leq 1.55\lambda 2/\varepsilon r^{1/2} \quad (4S')$$

The first sides 31*c* and 31*d* and the second sides 31*e* and 31*f* are positioned generally at the node of the electromagnetic wave of the second wavelength band radiated from the first ground conductor 31. Therefore, the resonance frequency of the electromagnetic wave of the second wavelength band shifts in accordance with the lengths Lg1 and Lg2. That is, the electromagnetic wave of the second wavelength band can be adjusted based on the lengths Lg1 and Lg2.

On the other hand, the first sides 31*c* and 31*d* and the second sides 31*e* and 31*f* are not positioned at the node of the electromagnetic wave of the first wavelength band radiated from the first ground conductor 31. Therefore, the characteristics of the electromagnetic wave of the first wavelength band do not change substantially when the lengths Lg1 and Lg2 change.

As described above, the first sides 31*c* and 31*d* and the second sides 31*e* and 31*f* preferably have sufficient lengths to accommodate the spread of the electromagnetic wave since they are positioned at the node of the electromagnetic wave. Note however that since the first ground conductor 31 is sufficiently larger than the first radiation conductor 11, it is possible to ensure sufficient lengths of the first sides 31*c* and 31*d* and the second sides 31*e* and 31*f* even when the first ground conductor 31 has a shape other than a rectangular shape. For example, the first ground conductor 31 may have an octagonal shape. In such a case, the first sides 31*c* and 31*d* and the second sides 31*e* and 31*f* are preferably arranged orthogonal to each other.

When the first radiation conductor 11 has a rectangular shape, the length of the first sides 11*c* and 11*d* is equal to Lrf2, which is the distance between the second sides 11*e* and 11*f*, and the length of the second sides 11*e* and 11*f* is equal to Lrf1, which is the distance between the first sides 11*c* and 11*d*.

Therefore, it is preferred that Conditions (1) to (4) below are satisfied when making a multi-band antenna that radiates electromagnetic waves by feeding power to one or both of the first strip conductor 21 and the second strip conductor 22.

$$0.2\lambda 1/\varepsilon r^{1/2} \leq Lrf1 \leq 0.7\lambda 1/\varepsilon r^{1/2} \quad (1)$$

$$0.2\lambda 1/\varepsilon r^{1/2} \leq Lrf2 \leq 0.7\lambda 1/\varepsilon r^{1/2} \quad (2)$$

$$0.7\lambda 2/\varepsilon r^{1/2} \leq Lg1 \leq 1.75\lambda 2/\varepsilon r^{1/2} \quad (3)$$

$$0.7\lambda 2/\varepsilon r^{1/2} \leq Lg2 \leq 1.75\lambda 2/\varepsilon r^{1/2} \quad (4)$$

It is preferred that Conditions (1M) to (4M) below are satisfied when making a multi-band antenna that radiates electromagnetic waves by feeding power to one or both of the first strip conductor 21 and the second strip conductor 22.

$$0.3\lambda 1/\varepsilon r^{1/2} \leq Lrf1 \leq 0.5\lambda 1/\varepsilon r^{1/2} \quad (1M)$$

$$0.3\lambda 1/\varepsilon r^{1/2} \leq Lrf2 \leq 0.5\lambda 1/\varepsilon r^{1/2} \quad (2M)$$

$$1\lambda 2/\varepsilon r^{1/2} \leq Lg1 \leq 1.25\lambda 2/\varepsilon r^{1/2} \quad (3M)$$

$$1\lambda 2/\varepsilon r^{1/2} \leq Lg2 \leq 1.25\lambda 2/\varepsilon r^{1/2} \quad (4M)$$

The first strip conductor 21 and the second strip conductor 22 are arranged between the first radiation conductor 11 and the first ground conductor 31 in the z-axis direction. The first strip conductor 21 and the second strip conductor 22 electromagnetically couple with the first radiation conductor 11 to feed the signal power. In the present embodiment, the first strip conductor 21 extends in the x-axis direction, and the second strip conductor 22 extends in a direction orthogonal to the direction in which the first strip conductor 21 extends, i.e., the y-axis direction. The interval d1 between the first radiation conductor 11 and the first strip conductor 21 and the second strip conductor 22 in the z-axis direction is 5 μm to 500 μm, for example.

The direction in which the first strip conductor 21 and the second strip conductor 22 extend is parallel to the first sides 11*c* and 11*d* or the second sides 11*e* and 11*f* of the first radiation conductor 11 and is parallel to the first sides 31*c* and 31*d* or the second sides 31*e* and 31*f* of the first ground conductor 31.

One end 23*a* of a feed conductor 23 is connected one end of each of the first strip conductor 21 and the second strip conductor 22. The feed conductor 23 extends in the z-axis direction, and is inserted through an opening 31*w* provided in the first ground conductor 31.

Although not shown in the figures, the other end 23*b* of the feed conductor 23 is connected to active components and passive components of the transmitting circuit and receiving circuit, and to wires that connect between these components, in an area of the dielectric 40 on the reverse surface 31*b* side of the first ground conductor 31. The signal power output from the transmitting circuit is fed to the first strip conductor 21 and the second strip conductor 22 through the feed conductor 23, and the signal power is further fed to the first radiation conductor through capacitive coupling.

Note that while the multi-band antenna 101 feeds the signal power from the first strip conductor 21 and the second strip conductor 22 to the first radiation conductor 11 through electromagnetic coupling by capacitive coupling in the present embodiment, the method of feeding the signal power to the first radiation conductor 11 is not limited thereto. The signal power may be fed to the first radiation conductor 11 by another method, instead of the first strip conductor 21 and the second strip conductor 22. For example, direct coupling feed may be used by connecting the conductor for feeding the signal power directly to the first radiation conductor 11, or slot feed wherein they are electromagnetically coupled together via a slotted conductor.

The dielectric 40 may be a resin, a glass, a ceramic, or the like, having a relative dielectric constant sr of about 1.5 to about 100. Preferably, the dielectric 40 is a multi-layer dielectric including a plurality of layers made of a resin, a glass, a ceramic, or the like. The dielectric 40 is a multi-layer ceramic body including a plurality of ceramic layers, for example, with the first radiation conductor 11, the first strip conductor 21, the second strip conductor 22 and the first ground conductor 31 provided between the plurality of ceramic layers, and with the feed conductor 23 provided in one or more of the ceramic layers. The first radiation conductor 11 may be provided on a primary surface 40*a* of the dielectric 40, and the first ground conductor 31 may be provided on a reverse surface 40*b* of the dielectric 40. The interval between components in the z-axis direction in the dielectric 40, etc., can be adjusted by changing the thickness and the number of ceramic layers arranged between components.

Components other than the dielectric 40 of the multi-band antenna 101 are each made of an electrically conductive material, e.g., a material including a metal such as Au, Ag, Cu, Ni, Al, Mo or W, for example.

The multi-band antenna 101 can be made by using a dielectric of a material mentioned above and a conductive material and using a technique known in the art. Particularly, it can be preferably made by using a multi-layer substrate technique using a resin, a glass and a ceramic. For example, when a multi-layer ceramic body is used as the dielectric 40, a co-fired ceramic substrate technique can be preferably used. In other words, the multi-band antenna 101 can be made as a co-fired ceramic substrate.

The co-fired ceramic substrate of the multi-band antenna 101 may be a low-temperature co-fired ceramic (LTCC) substrate or a high-temperature co-fired ceramic (HTCC) substrate. In view of the high-frequency characteristics, it may be preferred to use a low-temperature co-fired ceramic substrate. Ceramic materials and conductive materials selected in accordance with the firing temperature, the application, the frequency of wireless communication, etc., are used for the dielectric 40, the first radiation conductor 11, the first strip conductor 21, the second strip conductor 22 and the first ground conductor 31. The conductive paste for forming these elements and the green sheet for forming the multi-layer ceramic body of the dielectric 40 are co-fired. When the co-fired ceramic substrate is a low-temperature co-fired ceramic substrate, a ceramic material and a conductive material that can be co-fired in the temperature range of about 800° C. to about 1000° C. are used. For example, ceramic materials that can be used include those including Al, Si, Sr as a primary component and Ti, Bi, Cu, Mn, Na, K as a sub-component, those including A1, Si, Sr as a primary component and Ca, Pb, Na, K as a sub-component, those including A1, Mg, Si, Gd, and those including Al, Si, Zr, Mg. Or, a conductive material including Ag or Cu is used. The dielectric constant of the ceramic material is about 3 to about 15. When the co-fired ceramic substrate is a high-temperature co-fired ceramic substrate, a ceramic material including Al as a primary component and a conductive material including W (tungsten) or Mo (molybdenum) may be used.

More specifically, various materials can be used as the LTCC material, including an Al—Mg—Si—Gd—O-based dielectric material having a low dielectric constant (relative dielectric constant: 5 to 10), a dielectric material made of a crystal phase of $Mg_2SiO_4$ and an Si—Ba—La—B—O-based glass, an Al—Si—Sr—O-based dielectric material, an Al—Si—Ba—O-based dielectric material, and a Bi—Ca—Nb—O-based dielectric material having a high dielectric constant (relative dielectric constant: 50 or more), for example.

For example, it is preferred that an Al—Si—Sr—O-based dielectric material, when including an oxide of Al, Si, Sr, Ti as a primary component, preferably includes 10 to 60 wt % of $Al_2O_3$, 25 to 60 wt % of $SiO_2$, 7.5 to 50 wt % of SrO and 20 wt % or less (including 0) of $TiO_2$, when the primary components of Al, Si, Sr and Ti are measured in terms of $Al_2O_3$, $SiO_2$, SrO and $TiO_2$, respectively. For 100 parts by mass of the primary components, it is preferred that at least one selected from the group of Bi, Na, K and Co is included, as sub-components, by 0.1 to 10 parts by mass in terms of $Bi_2O_3$, 0.1 to 5 parts by mass in terms of $Na_2O$, 0.1 to 5 parts by mass in terms of $K_2O$, and 0.1 to 5 parts by mass in terms of CoO, and it is more preferred that at least one selected from the group of Cu, Mn and Ag is included by 0.01 to 5 parts by mass in terms of CuO, 0.01 to 5 parts by mass in terms of $Mn_3O_4$, and 0.01 to 5 parts by mass in terms of Ag. In addition, inevitable impurities may be included.

The operation of the multi-band antenna will now be described. When the signal power is fed to the first strip conductor 21, the multi-band antenna 101 radiates an electromagnetic wave that travels in the positive z-axis direction with an intensity distribution along a plane parallel to the direction in which the first strip conductor 21 extends. When the signal power is fed to the second strip conductor 22, the multi-band antenna 101 radiates an electromagnetic wave that travels in the positive z-axis direction with an intensity distribution along a plane parallel to the direction in which the second strip conductor 22 extends. By selectively feeding power to the strip conductors, it is possible to selectively radiate electromagnetic waves with different polarization directions of the multi-band antenna 101.

When the signal power is fed simultaneously to the first strip conductor 21 and the second strip conductor 22, the first radiation conductor 11 radiates an electromagnetic wave that is obtained by synthesizing two electromagnetic waves together. Since the two electromagnetic waves are orthogonal to each other, the signal generated from the received synthesized electromagnetic wave can be separated into two signals. Therefore, with the multi-band antenna 101, different signal powers can be radiated from the first radiation conductor 11 through the first strip conductor 21 and the second strip conductor 22, and it is possible to transmit/receive larger amounts of information.

Figure 5A:
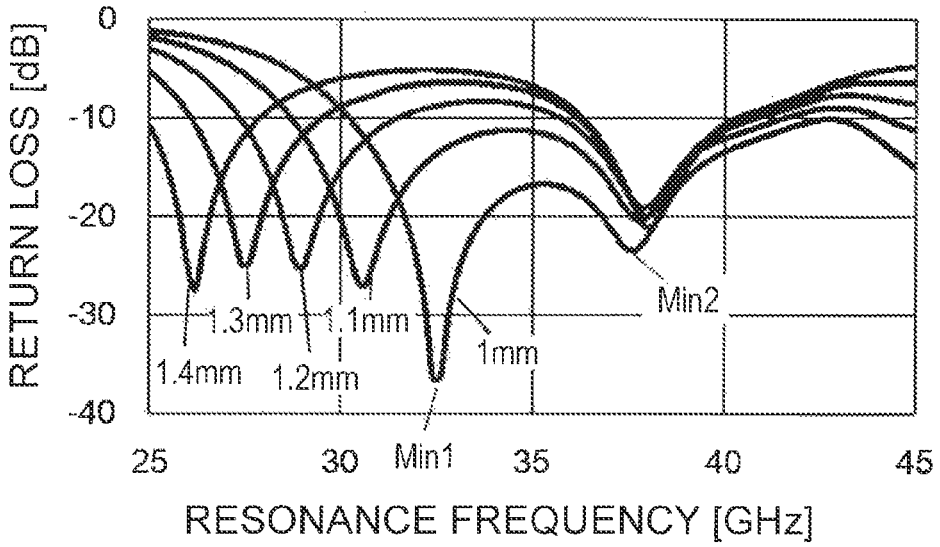
FIG. 5A is a graph showing a simulation result for the multi-band antenna of Embodiment 1.
Figure 5B:
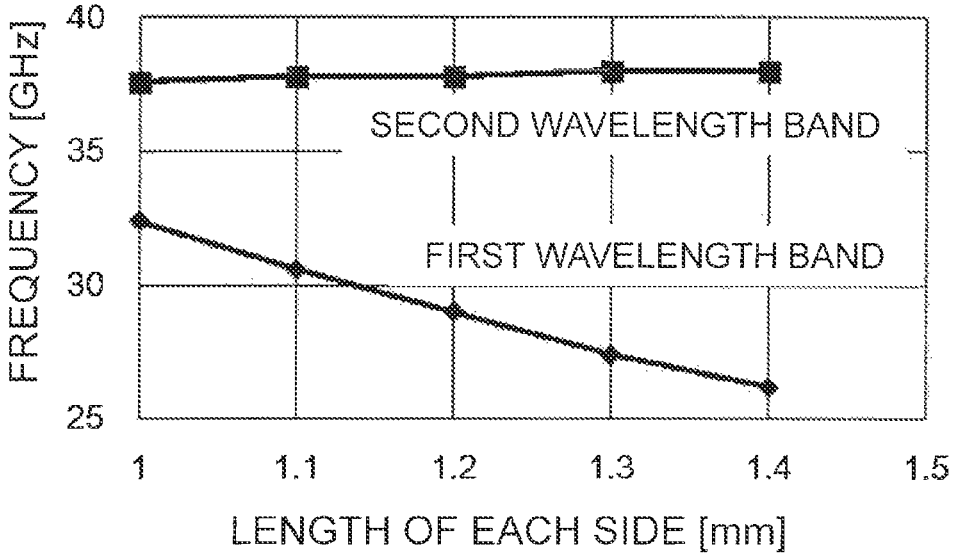
FIG. 5B is a graph showing a simulation result for the multi-band antenna of Embodiment 1.

Next, the relationship between the sizes of the first radiation conductor 11 and the first ground conductor 31 of the multi-band antenna 101 and the characteristics of the electromagnetic waves that can be radiated, as determined through simulation, will be described. FIG. 5A and FIG. 5B show characteristics of electromagnetic waves radiated when the size of the first radiation conductor 11 is varied while fixing the size of the first ground conductor 31. FIG. 5A shows the frequency characteristic of return loss, and FIG. 5B shows the relationship between the length of one side of the first radiation conductor 11 and the minimum value of return loss. Table 1 below shows values of parameters used in the simulation.

The calculation is done assuming that the first radiation conductor 11 and the first ground conductor 31 each have a square shape. That is, Lrf1=Lrf2, and the lengths of the first sides 11*c* and 11*d* and the lengths of the second sides 11*e* and 11*f* are all Lrf1. Similarly, Lg1=Lg2, and the lengths of the first sides 31*c* and 31*d* and the lengths of the second sides 31*e* and 31*f* are all Lg1.

TABLE 1

| | |
|---|---|
| Lrf1 and Lrf2 of first radiation conductor 11 | 1, 1.1, 1.2, 1.3, 1.4 mm |
| Lg1 and Lg2 of first ground conductor 31 | 4.5 mm |
| Relative dielectric constant εr of dielectric 40 | 8 |

As shown in FIG. 5A, when the length of each side of the first radiation conductor 11 is varied while fixing the size of the first ground conductor 31, the position of the minimum value Min2 of return loss seen at around 38 GHz does not change substantially. In contrast, the position of the minimum value Min1 of return loss seen at around 28 GHz shifts substantially when the length (Lrf1, Lrf2) of each side of the first radiation conductor 11 is varied. As shown in FIG. 5B, as Lrf1 increases, the minimum value Min1 of return loss shifts toward the lower frequency side. While Lrf1 is in the range of 1 to 1.4 mm, the value of Lrf1 and the frequency for the minimum value Min1 of return loss are proportional to each other.

Figure 6A:
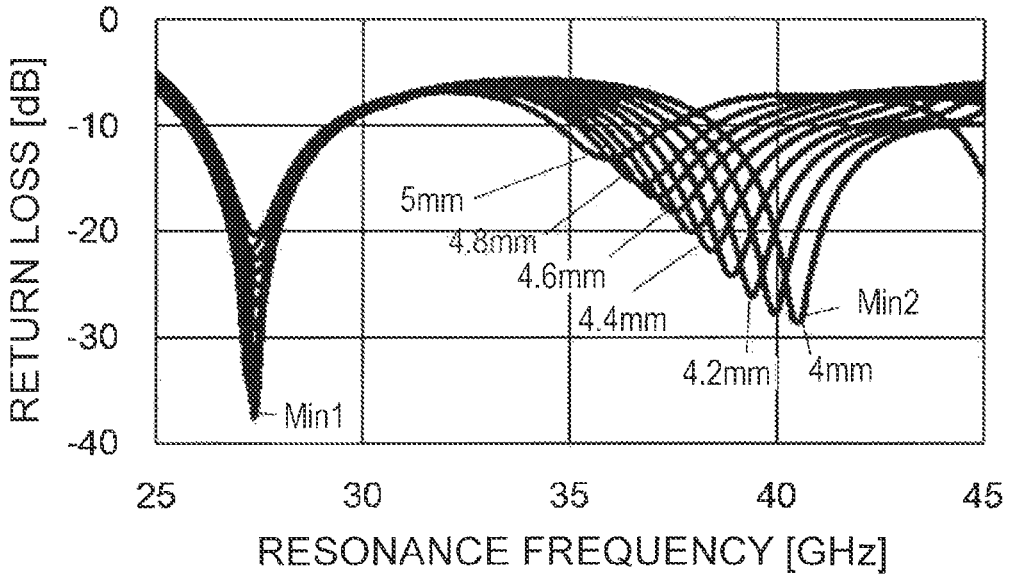
FIG. 6A is a graph showing a simulation result for the multi-band antenna of Embodiment 1.
Figure 6B:
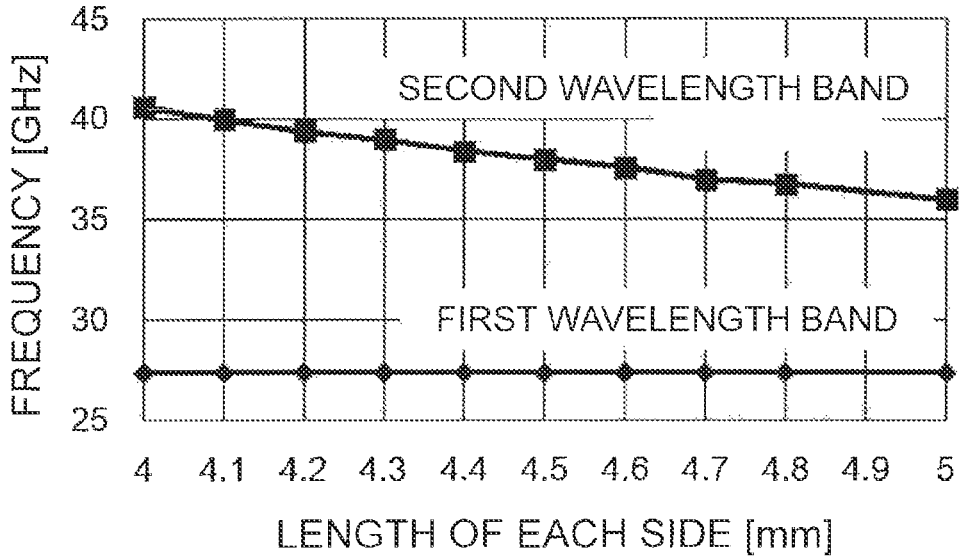
FIG. 6B is a graph showing a simulation result for the multi-band antenna of Embodiment 1.

FIG. 6A and FIG. 6B show the characteristics of the radiated electromagnetic wave when the size of the first ground conductor 31 is varied while fixing the size of the first radiation conductor 11. FIG. 6A shows the frequency characteristic of return loss, and FIG. 6B shows the relationship between the length of one side of the first ground conductor 31 and the minimum value of return loss. Table 2 below shows values of parameters used in the simulation.

TABLE 2

| | |
|---|---|
| Lrf1 and Lrf2 of first radiation conductor 11 | 1.3 mm |
| Lg1 and Lg2 of first ground conductor 31 | 4, 4.1, 4.2, 4.3, 4.4, 4.5, 4.6, 4.7, 4.8, 5 mm |
| Relative dielectric constant εr of dielectric 40 | 8 |

As shown in FIG. 6A, when the length of each side of the first ground conductor 31 is varied while fixing the size of the first radiation conductor 11, the position of the minimum value Min1 of return loss seen at around 28 GHz does not change substantially. In contrast, the position of the minimum value Min2 of return loss seen at around 38 GHz shifts substantially when the length (Lg1, Lg2) of each side of the first ground conductor 31 is varied. As shown in FIG. 6B, as Lg1 increases, the minimum value Min2 of return loss shifts toward the lower frequency side. While Lg1 is in the range of 4 to 5 mm, the value of Lrf1 and the frequency for the minimum value Min2 of return loss are proportional to each other.

From these results, it can be seen that the multi-band antenna 101 is capable of transmitting/receiving electromagnetic waves in two frequency bands, and the positions of the frequency bands can be shifted independently by varying the size of the first radiation conductor 11 and the size of the first ground conductor 31 (specifically, the distances Lrf1, Lrf2, Lg1 and Lg2 between pairs of sides). This means that of the electromagnetic waves radiated from the multi-band antenna 101, the electromagnetic wave of the first frequency band and the electromagnetic wave of the second frequency band (more specifically, the electromagnetic wave of the 28 GHz band and the electromagnetic wave of the 38 GHz band) are transmitted/received in different modes.

As can be seen from these characteristics, the present disclosure provides a novel antenna design method for multi-band antennas. Specifically, when designing a multi-band antenna capable of transmitting/receiving electromagnetic waves in a first wavelength band of a first center wavelength λ1 and a second wavelength band of a second center wavelength λ2, which is shorter than the first center wavelength λ1, the size of the first radiation conductor may be determined based on the first center wavelength λ1 and the size of the first ground conductor based on the second center wavelength λ2.

For example, first, the first center wavelength λ1 and the second center wavelength λ2 are identified based on the specifications of the multi-band antenna to be made. Next, the size of the first radiation conductor 11 is determined based on the first center wavelength λ1. Specifically, the distance Lrf1 between a pair of opposing first sides and the distance Lrf2 between a pair of opposing second sides of the first radiation conductor 11 are determined. More specifically, the distances Lrf1 and Lrf2 are determined so as to satisfy Expressions (1) and (2). In this process, the distances Lrf1 and Lrf2 may be varied within such a range that Expressions (1) and (2) are satisfied to determine the distances Lrf1 and Lrf2 that achieve a smaller minimum value Min1 of return loss.

Next, the size of the first ground conductor 31 is determined based on the second center wavelength λ2. Specifically, the distance Lg1 between a pair of opposing first sides and the distance Lg2 between a pair of opposing second sides of the first ground conductor 31 are determined. More specifically, the distances Lg1 and Lg2 are determined so as to satisfy Expressions (3) and (4). In this process, the distances Lg1 and Lg2 may be varied using the determined distances Lg1 and Lg2 within such a range that Expressions (3) and (4) are satisfied to determine the distances Lg1 and Lg2 that achieve a smaller minimum value Min2 of return loss.

Although the size of the first radiation conductor 11 is determined first and then the size of the first ground conductor 31 in the example described above, the size of the first ground conductor 31 may be determined first and then the size of the first radiation conductor 11. As described above, as long as Lrf1, Lrf2, Lg1 and Lg2 are varied within such a range that Expressions (1), (2), (3) and (4) are satisfied, the size of the first radiation conductor 11 does not substantially influence the radiation characteristic of the electromagnetic wave of the second frequency band, and the size of the first ground conductor 31 does not substantially influence the radiation characteristic of the electromagnetic wave of the first frequency band. Therefore, one may search for frequencies for the minimum values Min1 and Min2 of return loss through a simulation in which Lrf1, Lrf2, Lg1 and Lg2 are varied simultaneously.

Thus, with the multi-band antenna of the present embodiment, if at least the first radiation conductor 11 and the first ground conductor 31 are sized so that Expression (1) and Expression (3) are satisfied, the electromagnetic wave of the first frequency band and the electromagnetic wave of the second frequency band are transmitted/received in different modes. Therefore, the positions of the first frequency band and the second frequency band can be adjusted independently, thereby realizing a multi-band antenna and a method for designing a multi-band antenna with which it is easy to adjust the frequency bands used.

Embodiment 2

Figure 7:
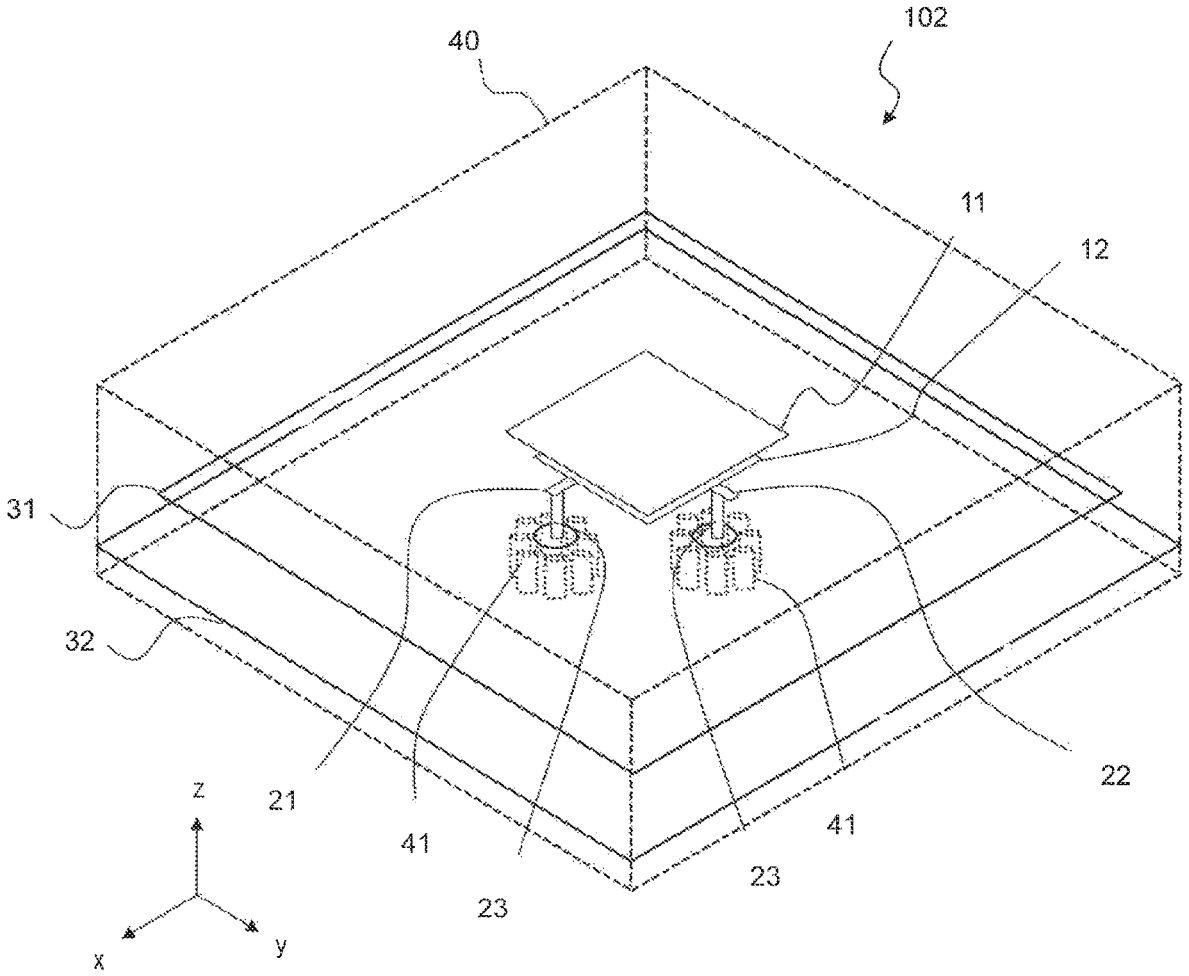
FIG. 7 is a perspective view showing an example multi-band antenna according to Embodiment 2.
Figure 8:
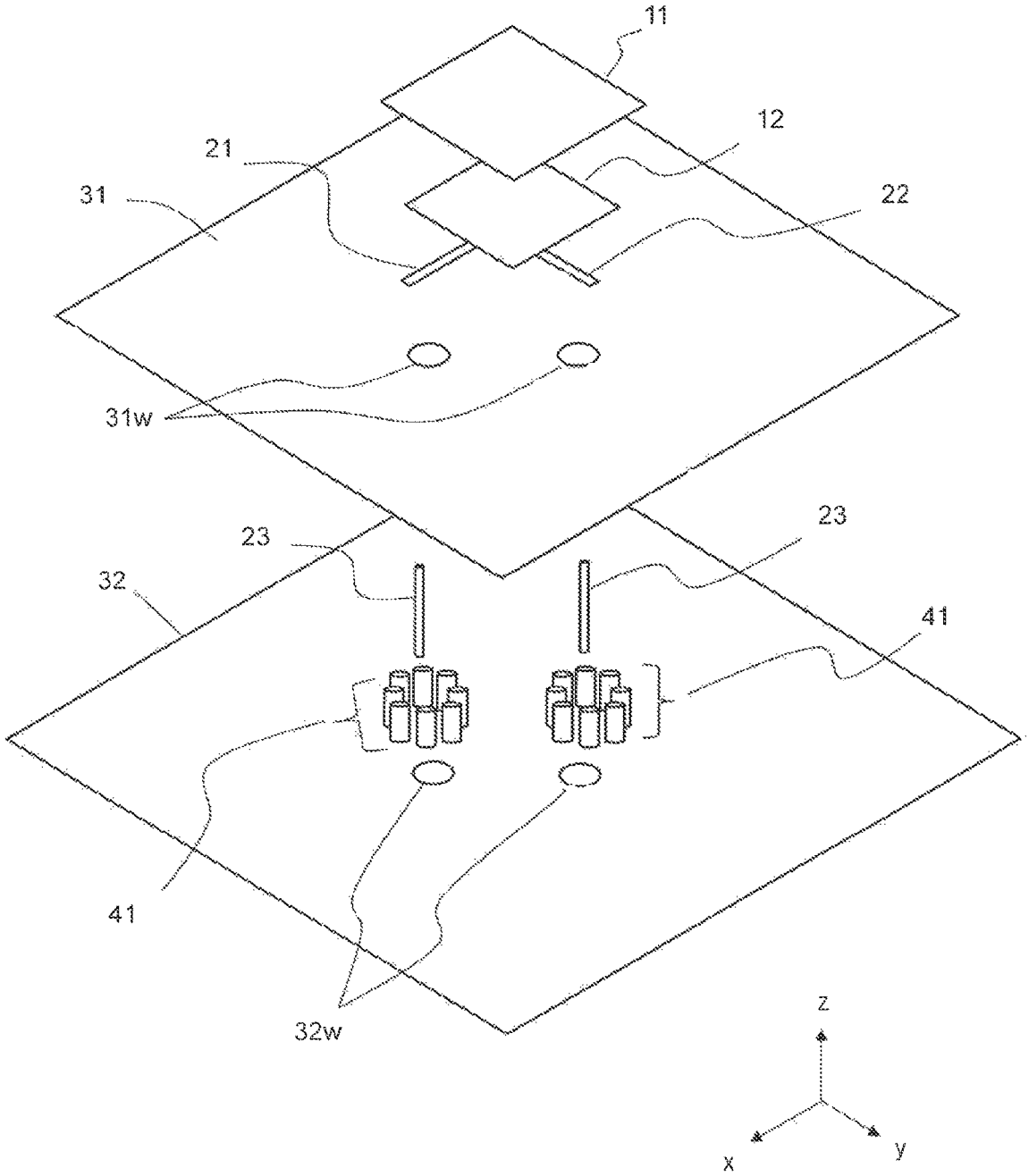
FIG. 8 is an exploded perspective view showing a part of the multi-band antenna of FIG. 7.
Figure 9:
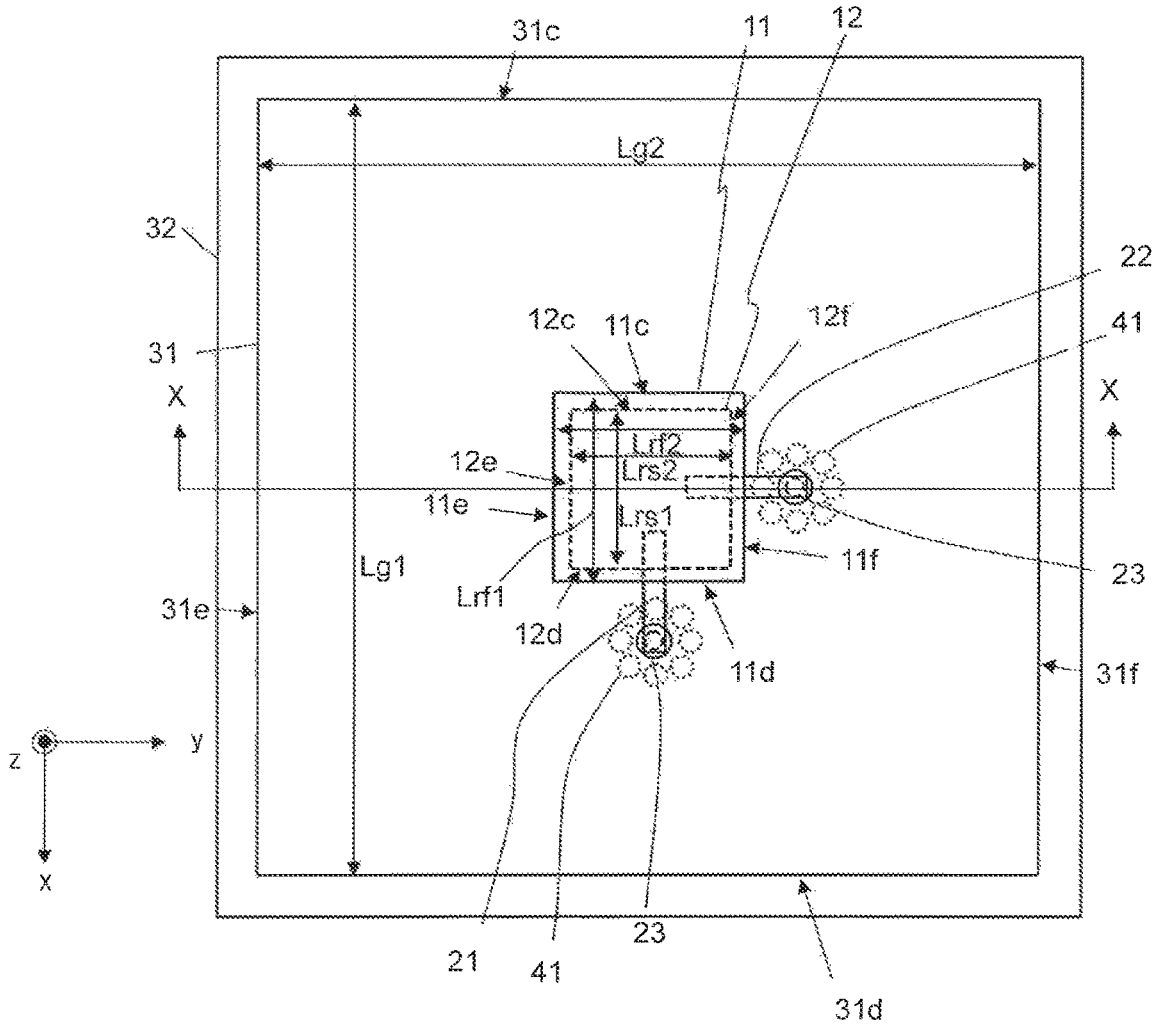
FIG. 9 is a plan view showing the multi-band antenna of FIG. 7.
Figure 10:
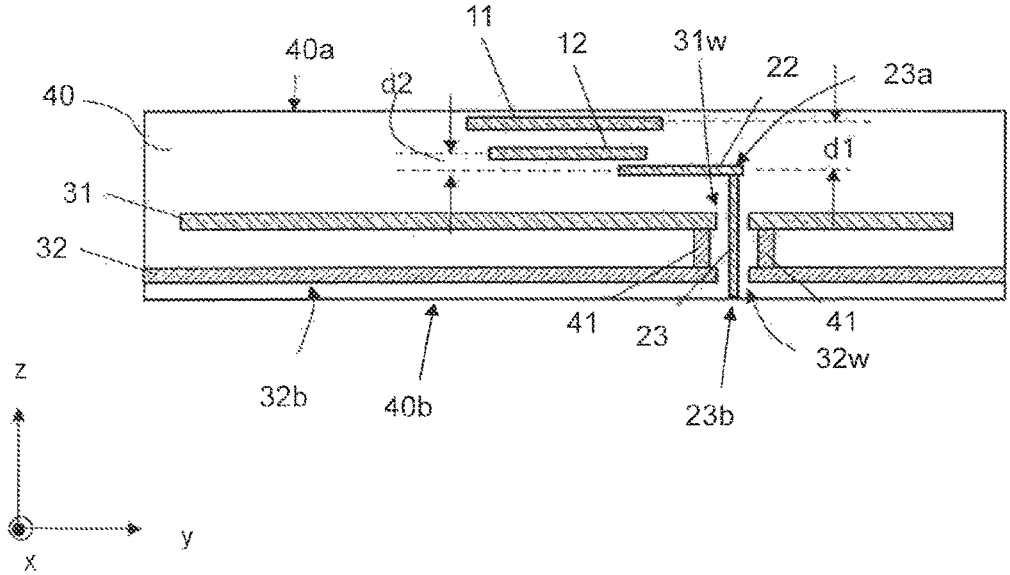
FIG. 10 is a cross-sectional view showing the multi-band antenna taken along line X-X of FIG. 9.

A multi-band antenna according to Embodiment 2 of the present disclosure will be described. FIG. 7 is a schematic perspective view showing a multi-band antenna 102 of the present disclosure. FIG. 8 is an exploded perspective view showing main components of the multi-band antenna 102. FIG. 9 is a plan view showing the multi-band antenna 102, and FIG. 10 is a cross-sectional view taken along line X-X of FIG. 9. The multi-band antenna 102 is different from the multi-band antenna 101 of Embodiment 1 in that it further includes a second radiation conductor 12, a second ground conductor 32, and a plurality of first via conductors 41.

The second radiation conductor 12 is a planar conductor arranged generally parallel to the xy plane. The second radiation conductor 12 is located between the first radiation conductor 11 and the first ground conductor 31 in the z-axis direction. Where the multi-band antenna 102 includes the first strip conductor 21 and the second strip conductor 22, the second radiation conductor 12 is located between the first radiation conductor 11 and the first strip conductor 21 and the second strip conductor 22.

Of the electromagnetic waves radiated from the first radiation conductor 11, the second radiation conductor 12 particularly widens the band for the electromagnetic wave of the first wavelength band. The second radiation conductor 12 has a planar shape having at least a pair of opposing first sides 12*c* and 12*d*. In the present embodiment, the second radiation conductor 12 has a rectangular shape having two pairs of sides that are generally parallel to the x-axis direction and the y-axis direction, respectively. Specifically, the second radiation conductor 12 has a pair of opposing first sides 12*c* and 12*d* and a pair of opposing second sides 12*e* and 12*f*.

The distance Lrs1 between the pair of opposing first sides 12*c* and 12*d* satisfies Expression (5) below.

$$0.2\lambda 1/\varepsilon r^{1/2} \leq Lrs1 \leq 0.5\lambda 1/\varepsilon r^{1/2} \quad (5)$$

Preferably, the distance Lrs2 between the pair of opposing second sides 12*e* and 12*f* satisfies Expression (6) below.

$$0.2\lambda 1/\varepsilon r^{1/2} \leq Lrs2 \leq 0.5\lambda 1/\varepsilon r^{1/2} \quad (6)$$

Lrs2 and Lrs1 may be equal to each other or may be different from each other. More preferably, Lrs1 and Lrs2 satisfy Expressions (5') and (6') below.

$$0.25\lambda 1/\varepsilon r^{1/2} \leq Lrs1 \leq 0.4\lambda 1/\varepsilon r^{1/2} \quad (5')$$

$$0.25\lambda 1/\varepsilon r^{1/2} \leq Lrs2 \leq 0.4\lambda 1/\varepsilon r^{1/2} \quad (6')$$

The second radiation conductor 12 is preferably smaller than the first radiation conductor 11 as seen from above. That is, the outer edge of the second radiation conductor 12 is preferably located inside the outer edge of the first radiation conductor 11. Therefore, it is preferred that Lrf1>Lrs1 and Lrf2>Lrs2.

The interval d2 between the second radiation conductor 12 and the first strip conductor 21 and the second strip conductor 22 in the z-axis direction is 5 μm to 500 μm, for example. The interval d1 between the first radiation conductor 11 and the first strip conductor 21 and the second strip conductor 22 may be equal to d1 in the multi-band antenna 101 of Embodiment 1.

The second ground conductor 32 is a planar conductor generally parallel to the xy plane, and is arranged on the opposite side from the first radiation conductor 11 relative to the first ground conductor 31 in the z-axis direction. The second ground conductor 32 is larger than the first ground conductor 31 and has an outer edge that surrounds the first ground conductor 31 as seen from above.

The second ground conductor 32 has openings 32*w*, and the feed conductor 23 is inserted through the opening 32*w* of the second ground conductor 32, with the other end 23*b* of the feed conductor 23 located on the reverse surface 32*b* side of the second ground conductor 32.

The second ground conductor 32 may function as a ground electrode for the multi-band antenna 102 as a whole, or as a ground electrode for a transmitting circuit and a receiving circuit that include active and passive components, such as filters, amplifiers, chip components and digital ICs, which may be arranged under the second ground conductor 32.

The first via conductors 41 are arranged so as to sandwich or surround each feed conductor 23 as seen from above. Moreover, the first via conductors 41 connect together the first ground conductor 31 and the second ground conductor 32. For example, eight first via conductors 41 are arranged so as to surround each feed conductor 23 in the present embodiment. The first via conductors 41 shields the feed conductors 23, and prevent the feed conductors 23 from electromagnetically coupling with the first ground conductor 31.

With the multi-band antenna 102 of the present embodiment, the provision of the second radiation conductor 12 widens the portion of the 28 GHz band, which is the first wavelength band, where return loss is small. That is, widening of the 28 GHz band is realized. With the second ground conductor 32 and the first via conductors 41, it is also possible to control the impedance of the feed conductor 23 to an appropriate value (e.g., 50 ohm), and to reduce unnecessary resonance or reflection of the electromagnetic wave.

Embodiment 3

Figure 11A:
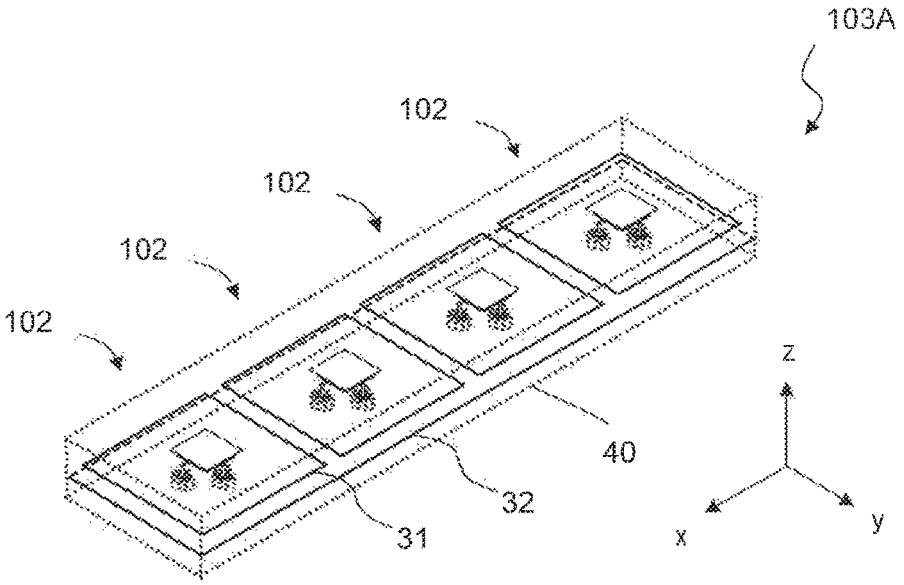
FIG. 11A is a perspective view showing an example multi-band antenna according to Embodiment 3.
Figure 11B:
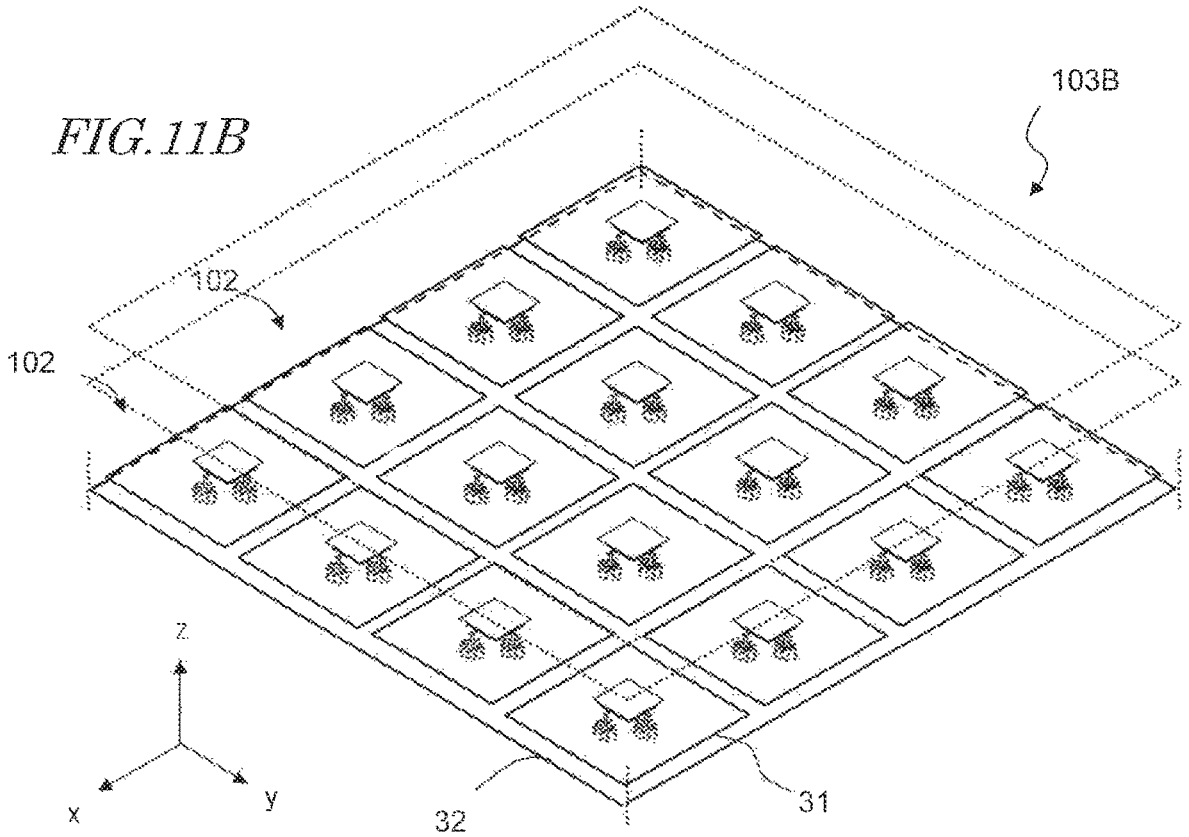
FIG. 11B is a perspective view showing another example multi-band antenna according to Embodiment 3.

A multi-band antenna according to Embodiment 3 of the present disclosure will be described. FIG. 11A and FIG. 11B are schematic perspective views showing multi-band antennas 103A and 103B of the present disclosure, respectively. The multi-band antennas 103A and 103B of the present embodiment each include, as antenna units, a plurality of multi-band antennas 101 of Embodiment 1 or multi-band antennas 102 of Embodiment 2, thereby forming an antenna array.

The multi-band antenna 103A shown in FIG. 11A includes a plurality of multi-band antennas 102 in a one-dimensional array. Although the multi-band antenna 102 is arranged in the x direction in FIG. 11A, it may be arranged in the y direction. In the multi-band antenna 103A, the second ground conductor 32 of each multi-band antenna 102 is connected to the second ground conductor 32 of each adjacent multi-band antenna 102. Therefore, in the multi-band antenna 103A, the second ground conductors 32 together form a continuous planar conductor. The first ground conductors 31 are separated from each other.

The multi-band antenna 103B shown in FIG. 11B includes a plurality of multi-band antennas 102 in a two-dimensional array. In FIG. 11B, the multi-band antennas 102 are arranged in a two-dimensional array that extends in the x direction and the y-axis direction. In the multi-band antenna 103B, the second ground conductor 32 of each multi-band antenna 102 is connected to the second ground conductor 32 of each adjacent multi-band antenna 102. Therefore, in the multi-band antenna 103B, the second ground conductors 32 together form a continuous planar conductor.

With the multi-band antennas 103A and 103B, there is no limitation on the number of multi-band antennas 102 to be provided as antenna units, and the examples shown in FIG. 11A and FIG. 11B are illustrative. With the multi-band antennas 103A and 103B, the arrangement pitch of multi-band antennas 102 (the distance between the centers of the multi-band antennas 102) in the x-axis direction or the y-axis direction is 3 mm to 6 mm, for example.

The multi-band antennas 103A and 103B are each a planar array antenna. If signal powers are fed, in phase, to the multi-band antennas 102, the electromagnetic waves radiated from the multi-band antennas 102 are synthesized together, and it is possible to radiate an electromagnetic wave with higher directivity. On the other hand, if signal powers are fed to the multi-band antennas 102 with phase difference and amplitude difference therebetween, it is possible to control the distribution and the direction of travel of the electromagnetic wave, i.e., beam forming. The multi-band antennas 103A and 103B are capable of beam forming of electromagnetic waves in the first and second frequency bands.

Embodiment 4

Figure 12:
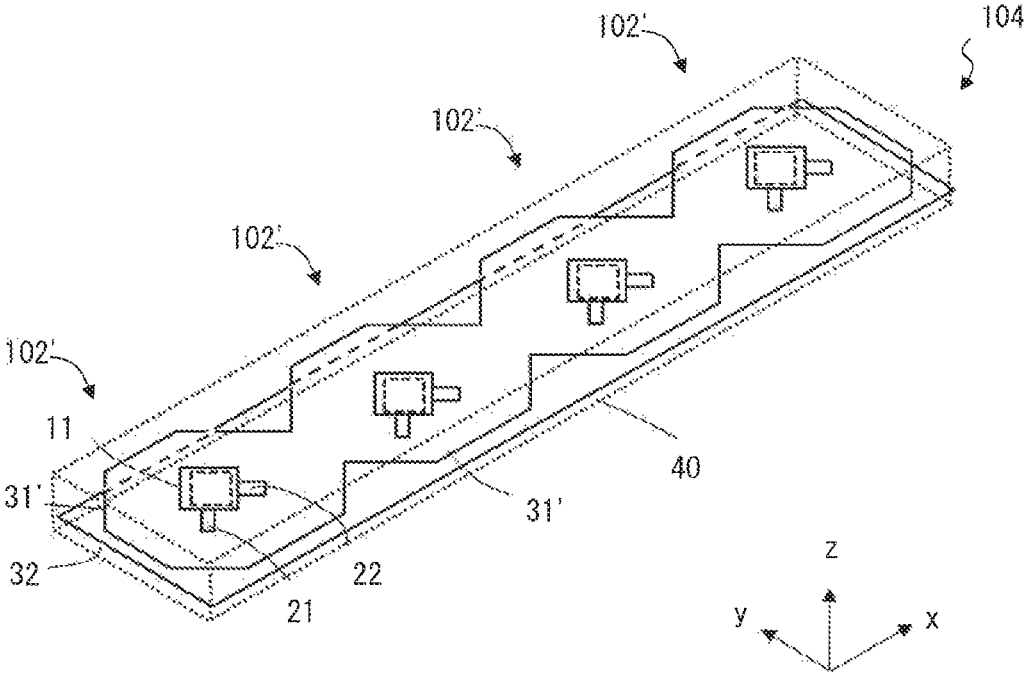
FIG. 12 is a perspective view showing an example multi-band antenna according to Embodiment 4.
Figure 13:
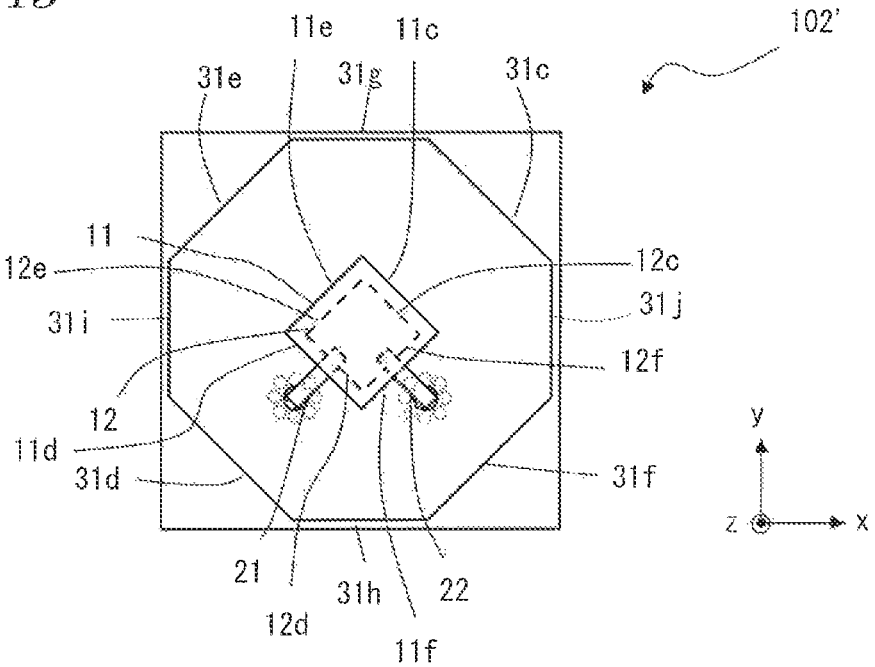
FIG. 13 is a plan view showing one antenna unit of the multi-band antenna of FIG. 12.

A multi-band antenna according to Embodiment 3 of the present disclosure will be described. FIG. 12 is a schematic perspective view showing a multi-band antenna 104 of the present disclosure. The multi-band antenna 104 includes, as antenna units, a plurality of multi-band antennas 102' in a one-dimensional array extending in the x direction. FIG. 13 is a schematic plan view showing a multi-band antenna 102'.

The multi-band antenna 102' is different from the multi-band antenna 102 of Embodiment 2 in that a first ground conductor 31' has an octagonal shape. The multi-band antenna 102' includes the first radiation conductor 11, the second radiation conductor 12, the first strip conductor 21, the second strip conductor 22, the first ground conductor 31' and the second ground conductor 32. The arrangement of the first radiation conductor 11, the second radiation conductor 12, the first strip conductor 21, the second strip conductor 22, the first ground conductor 31' and the second ground conductor 32 in the z-axis direction is the same as that of the multi-band antenna 102.

The first radiation conductor 11, the second radiation conductor 12, the first strip conductor 21 and the second strip conductor 22 of the multi-band antenna 102' are oriented by −45±3° about the z axis relative to those of the multi-band antenna 102. Therefore, the first strip conductor 21 and the second strip conductor 22 are located in symmetry with each other relative to the yz plane.

In the first radiation conductor 11 and the second radiation conductor 12, the first sides 11*c*, 11*d*, 12*c* and 12*d* are at an angle of 45±3° relative to the x axis, and the second sides 11*e*, 11*f*, 12*e* and 12*f* are at an angle of −45±3° relative to the x axis. The first sides 11*c*, 11*d* and 12*c*, 12*d* satisfy Expressions (1) and (5), respectively, and the second sides 11*e*, 11*f* and 12*e*, 12*f* satisfy Expressions (2) and (6), respectively.

The first ground conductor 31' includes a pair of opposing first sides 31*c* and 31*d*, a pair of opposing second sides 31*e* and 31*f*, a pair of opposing third sides 31*g* and 31*h*, and a pair of opposing fourth sides 31*i* and 31*j*. The first sides 31*c* and 31*d* are at an angle of 45±3° relative to the x axis, and cross the first strip conductor 21. The second sides 31*e* and 31*f* are at an angle of −45±3° relative to the x axis, and cross the second strip conductor 22. The first sides 31*c* and 31*d* and the second sides 31*e* and 31*f* satisfy Expressions (3) and (4), respectively. The third sides 31*g* and 31*h* and the fourth sides 31*i* and 31*j* are parallel to the x axis and the y axis, respectively.

Note however that as shown in FIG. 12, each first ground conductor 31' is connected in the x-axis direction to the first ground conductor 31' of each adjacent multi-band antenna 102'. Specifically, except for multi-band antennas 102' at the opposite ends in the x-axis direction, the fourth side 31*j* of the first ground conductor 31' is connected to the fourth side 31*i* of the first ground conductor 31' of each adjacent multi-band antenna 102'. At the multi-band antennas 102' located at the opposite ends in the x-axis direction, the fourth side 31*i* or the fourth side 31*j* of the first ground conductor 31' is connected to the fourth side 31*j* or 31*i*, respectively, of the first ground conductor 31' of an adjacent multi-band antenna 102'.

Although the first ground conductor 31' of the multi-band antenna 102' is connected to the first ground conductor 31' of each adjacent multi-band antenna 102' in the present embodiment, the first ground conductor 31' of the multi-band antenna 102' may be separated from the first ground conductor 31' of each adjacent multi-band antenna 102'. Although the first ground conductor 31' has an octagonal shape that includes the third sides 31*g* and 31*h* and the fourth sides 31*i* and 31*j*, the first ground conductor 31' may have any other shape. For example, depending on the distance Lg1 between the first sides 31*c* and 31*d*, the distance Lg2 between the second sides 31*e* and 31*f*, and the arrangement pitch of the multi-band antennas 102' in the x-axis direction, the first ground conductor 31' may have no third sides 31*g* and 31*h*, wherein the first side 31*c* and the second side 31*e* are in contact with each other and the first side 31*d* and the second side 31*f* are in contact with each other. Moreover, the first ground conductor 31' may have no fourth sides 31*i* and 31*j*, wherein the first side 31*d* and the second side 31*e* are in contact with each other and the first side 31*c* and the second side 31*f* are in contact with each other. In such a case, the first ground conductor 31' of each multi-band antenna 102' has a square shape, wherein each side is at an angle of 45° or −45° relative to the x axis, and the first ground conductor 31' is separated from each adjacent first ground conductor 31' or is in contact with each adjacent first ground conductor 31' at a vertex.

Similar to Embodiments 1 and 2, with the multi-band antenna 104, at least the first radiation conductor 11 and the first ground conductor 31' are sized so as to satisfy Expression (1) and Expression (3), thereby transmitting/receiving the electromagnetic wave of the first frequency band and the electromagnetic wave of the second frequency band in different modes. Therefore, the position of the center frequency (resonance frequency) can be adjusted independently for the electromagnetic wave of the first frequency band and for the electromagnetic wave of the second frequency band, thereby realizing a planar array antenna and a method for designing the same with which it is easy to adjust the frequency bands used.

In each multi-band antenna 102' of the multi-band antenna 104, when the signal power is fed simultaneously to the first strip conductor 21 and the second strip conductor 22, the multi-band antenna 102' generates electromagnetic waves whose distributions extend along planes that are inclined from the xz plane by +45° and −45° about the z axis. The electromagnetic wave obtained by synthesizing together the two electromagnetic waves has an intensity distribution extending along the xz plane and the yz plane with the maximum intensity in the positive z-axis direction.

The electromagnetic wave generated by the signal power fed to the first strip conductor 21 and the electromagnetic wave generated by the signal power fed to the second strip conductor 22 are distributed in symmetry relative to the xz plane, which includes the x axis, which is the direction of antenna arrangement, thereby reducing the spread of electromagnetic waves caused by asymmetry of electromagnetic waves, and reducing the influence of inadvertent interference from adjacent antennas.

Moreover, the first sides 11*c* and 11*d* and the second sides 11*e* and 11*f* of the first radiation conductor 11 and the first sides 31*c* and 31*d* and the second sides 31*e* and 31*f* of the first ground conductor 31, which are positioned at the node of the electromagnetic wave, are at angles as described above relative to the x axis, thereby reducing the adverse influence such as inadvertent interference with electromagnetic waves radiated from adjacent multi-band antennas 102'. Therefore, the multi-band antenna 104 is capable of beam forming with higher directivity.

Figure 14:
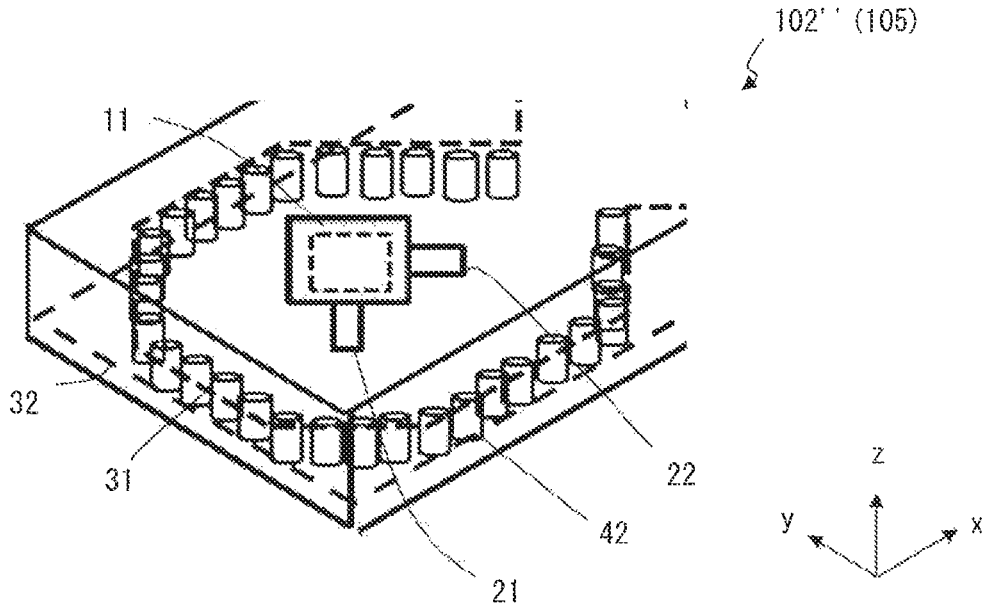
FIG. 14 is a perspective view showing, on an enlarged scale, another example multi-band antenna according to Embodiment 4.

Various modifications can be made to the multi-band antenna 104. FIG. 14 is a perspective view showing, on an enlarged scale, a multi-band antenna 102", which is one antenna unit of a multi-band antenna 105. The multi-band antenna 105 is different from the multi-band antenna 102' in that the multi-band antenna 105 includes a plurality of multi-band antennas 102", wherein each multi-band antenna 102" includes at least one second via conductor 42 that connects together the first ground conductor 31 and the second ground conductor 32. In the present embodiment, the multi-band antenna 102" includes a plurality of second via conductors 42. The second via conductors 42 are arranged parallel to and along (i.e., aligned with or on the inner side of) the outer edge of the first ground conductor 31, with one end thereof connected to the first ground conductor 31 and the other end thereof connected to the second ground conductor 32. Each second via conductor 42 may have one end thereof connected to the first ground conductor 31 with the other end thereof not connected to the second ground conductor 32. The diameter and the pitch of the second via conductors 42 may be similar to those of the first via conductors 41. Although there are spaces between the second via conductors 42 in FIG. 14, the second via conductors 42 may be in contact with each other on their side surface.

The second via conductors 42 can form a wall that is orthogonal to the resonance direction (the 45° direction when power is fed simultaneously to the first and second strip conductors), thereby adding the effect that resonance is allowed to occur inside the space created by the second via conductors 42. It is possible to control the impedance and the resonance frequency by controlling the distance in the resonance direction (the 45° direction when power is fed simultaneously to the first and second strip conductors) of the space surrounded by the second via conductors 42.

The second via conductors 42 function as a shield that reduces leakage of the electromagnetic wave radiated from the first radiation conductor 11 into adjacent multi-band antennas 102". Thus, it is possible to realize a multi-band antenna capable of reducing the adverse influence between multi-band antennas 102" and capable of beam forming with higher directivity.

Embodiment 5

Figure 15:
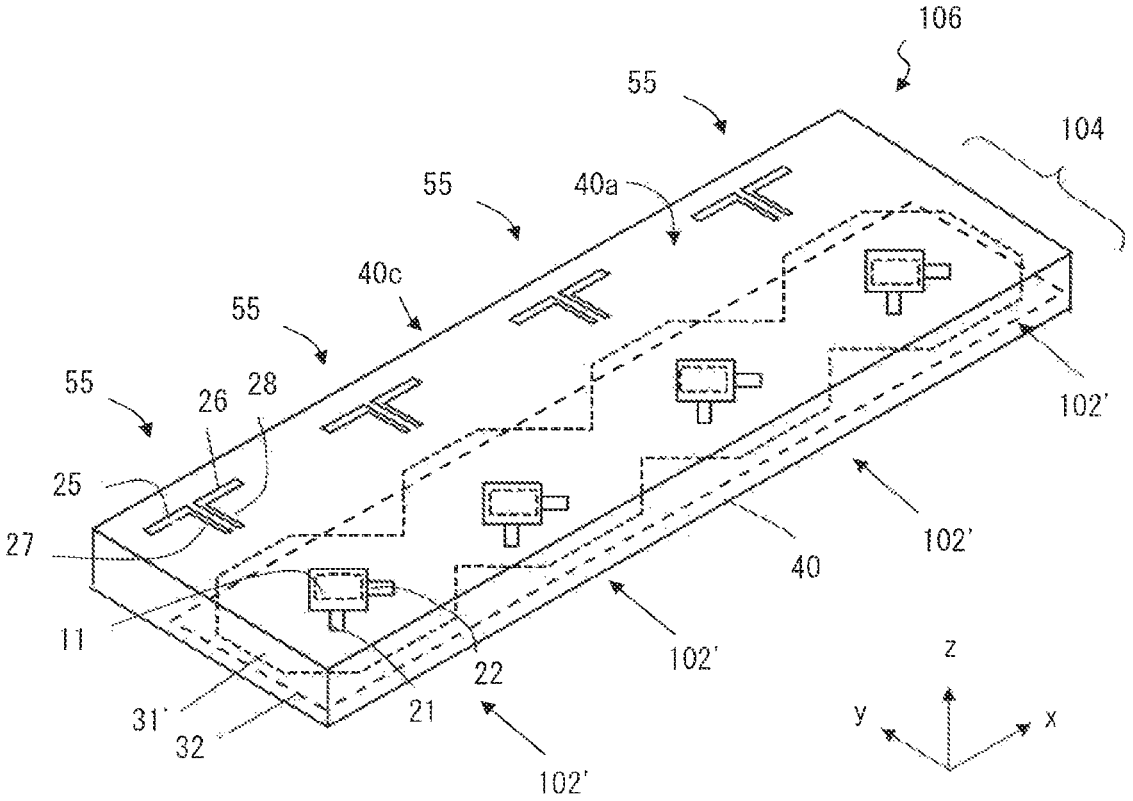
FIG. 15 is a perspective view showing an example multi-band antenna according to Embodiment 5.

A multi-band antenna according to Embodiment 5 will be described. FIG. 15 is a schematic perspective view showing a multi-band antenna 106 of the present disclosure. The multi-band antenna 106 is a multi-axis antenna, and includes the multi-band antenna 104 and a plurality of linear antennas 55. The multi-band antenna 104 has the same structure as that described in Embodiment 4 above.

The linear antennas 55 are spaced apart from each other in the y-axis direction, and each linear antenna 55 corresponds to one of the multi-band antennas 102' of the multi-band antenna 104. Each linear antenna 55 includes one or two linear radiation conductors extending parallel to the x-axis direction. In the embodiment shown in FIG. 15, the linear antenna 55 includes linear radiation conductors 25 and 26. The linear radiation conductors 25 and 26 each have a stripe shape extending in the x-axis direction, and are arranged close to each other in the x-axis direction. One multi-band antenna 102' and one linear antenna 55 arranged in the y-axis direction together form one antenna unit.

The linear antenna 55 further includes feed conductors 27 and 28 for feeding signal powers to the linear radiation conductors 25 and 26. The feed conductors 27 and 28 each have a stripe shape extending in the y-axis direction. One end of the feed conductor 27 and one end of the feed conductor 28 are respectively connected to one end of the linear radiation conductor 25 and one end of the linear radiation conductor 26 that are adjacent to each other.

The linear radiation conductors 25 and 26 of the linear antenna 55 may or may not overlap with the second ground conductor 32 as seen from the z-axis direction. When the linear radiation conductors 25 and 26 of the linear antenna 55 do not overlap with the second ground conductor 32 as seen from the z-axis direction, it is preferred that the linear radiation conductors 25 and 26 of the linear antenna 55 are spaced apart by λ/8 or more from the edge of the second ground conductor 32 in the y-axis direction. When the linear radiation conductors 25 and 26 overlap with the second ground conductor 32 as seen from the z-axis direction, it is preferred that the second ground conductor 32 and the linear radiation conductors 25 and 26 are spaced apart from each other by λ/8 or more in the z-axis direction.

A portion of the linear antenna 55 that includes the other end of the feed conductors 27 and 28 may overlap with the second ground conductor 32 as seen from the z-axis direction. The other end of one of the feed conductors 27 and 28 is connected to the reference potential, and the other end of the other one of the feed conductors 27 and 28 receives the signal power. The length of the linear radiation conductors 25 and 26 in the x-axis direction is about 1.2 mm, for example. The length (width) thereof in the y-axis direction is about 0.2 mm, for example.

Figure 16:
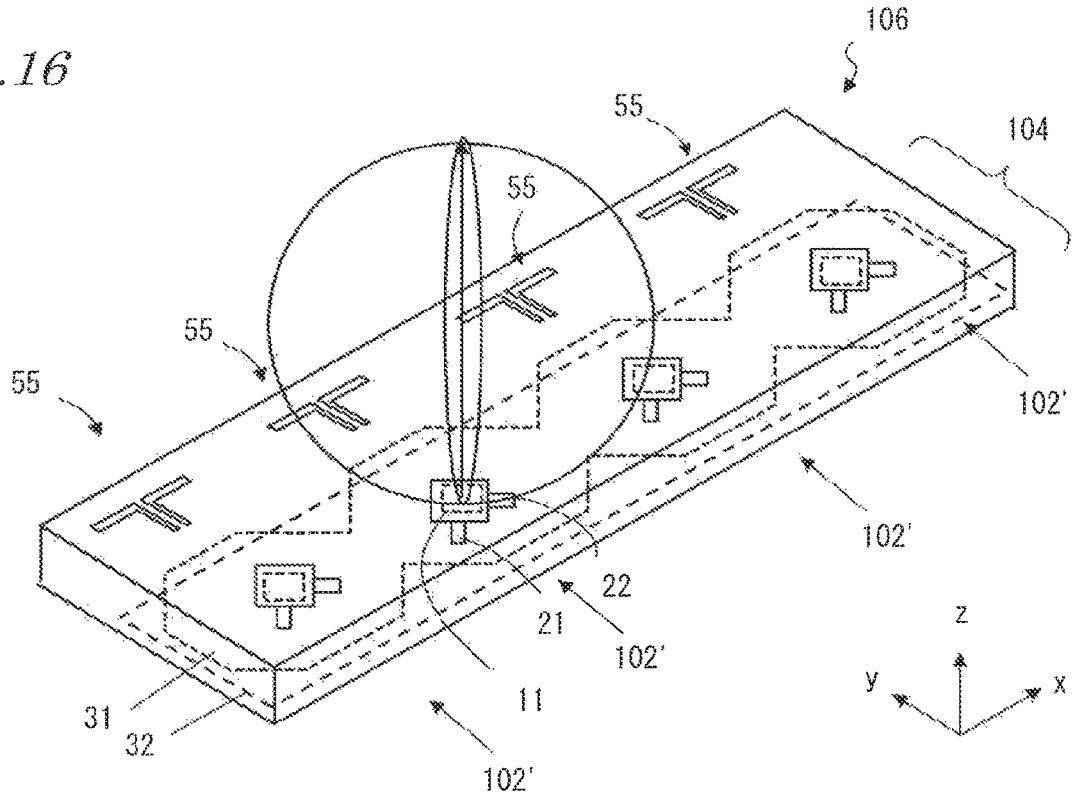
FIG. 16 is a schematic view illustrating the intensity distribution of electromagnetic waves radiated from the multi-band antenna of FIG. 15.
Figure 17:
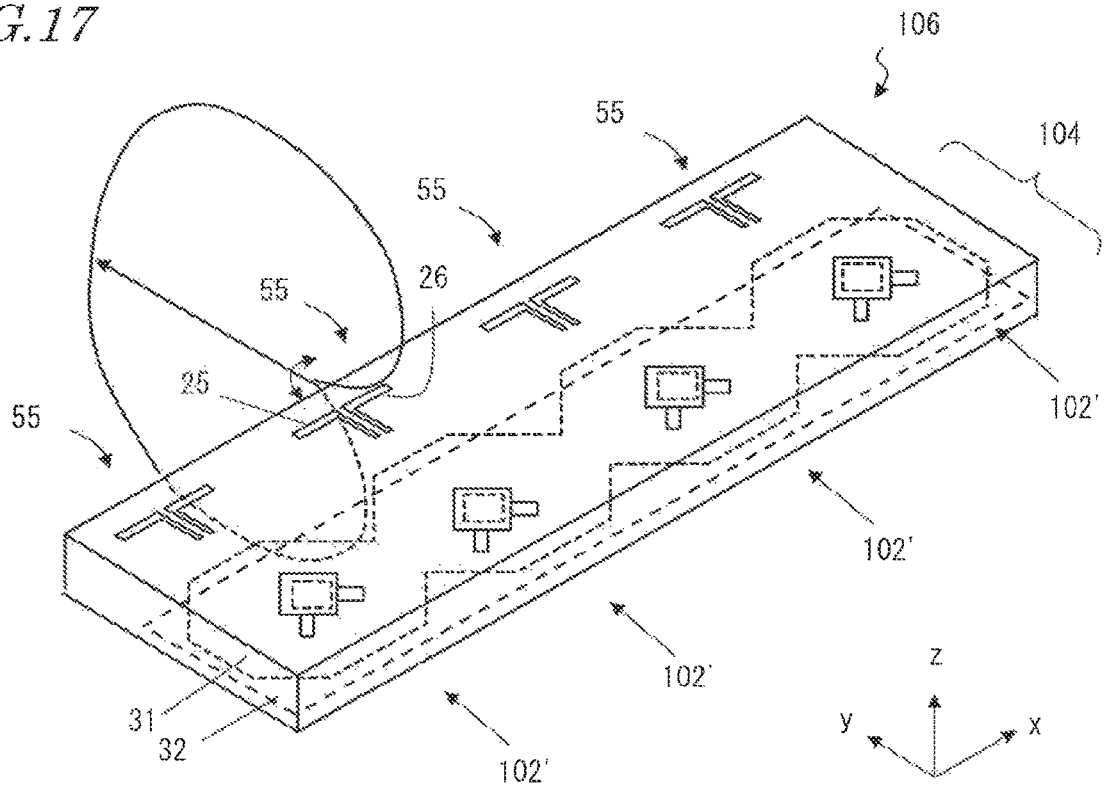
FIG. 17 is a schematic view illustrating the intensity distribution of electromagnetic waves radiated from the multi-band antenna of FIG. 15.

With reference to FIG. 16 and FIG. 17, the operation of the multi-band antenna 106 will be described. In the multi-band antenna 106, when the signal power is fed simultaneously or selectively to the multi-band antennas 102' of the antenna units through the first strip conductor 21 and the second strip conductor 22, the first radiation conductors 11 as a whole radiate an electromagnetic wave that has an intensity distribution $F_{+z}$ such that the maximum intensity is along a direction perpendicular to the first radiation conductor 11, i.e., the positive z-axis direction, as shown in FIG. 16. On the other hand, as shown in FIG. 17, when the signal power is fed to the linear antennas 55 of the antenna units, the linear radiation conductors 25 and 26 as a whole radiate an electromagnetic wave that has an intensity distribution $F_{+y}$ extending along the yz plane such that the maximum intensity is along the positive y-axis direction.

In the multi-band antenna 106, the multi-band antenna 102' and the linear antenna 55 may be used simultaneously or may be used selectively. Where it is not desirable that the gain lowers due to interference when these antennas are fed simultaneously (e.g., where signal powers are fed, in phase, to the multi-band antenna 102' and the linear antenna 55), an RF switch, or the like, may be used so that the signal to be transmitted/received is input selectively to the multi-band antenna 102' or the linear antenna 55.

When the multi-band antenna 102' and the linear antenna 55 are used simultaneously, it is preferred to give a phase difference between signals that are input to the multi-band antenna 102' and the linear antenna 55. This can reduce interference, thereby improving the gain. For example, a phase shifter, or the like, including a diode switch, an MEMS switch, or the like, may be used so that the signal to be transmitted/received is input selectively to the multi-band antenna 102' or the linear antenna 55.

The multi-band antenna 106 includes a plurality of antenna units. Therefore, the multi-band antenna 106 is also capable of beam forming of electromagnetic waves radiated from the multi-band antenna 102' and the linear antenna 55.

Embodiment 6

Figure 18:
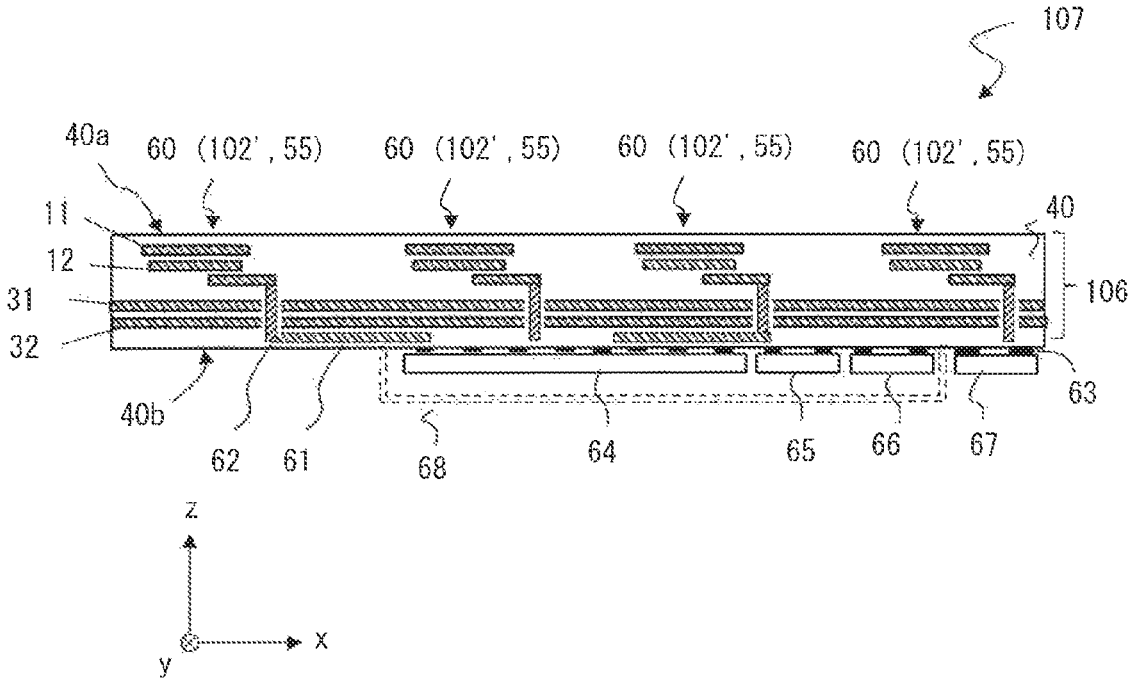
FIG. 18 is a schematic cross-sectional view showing an embodiment of a wireless communication module.

An embodiment of a wireless communication module of the present disclosure will be described. FIG. 18 is a schematic cross-sectional view showing a wireless communication module 107 taken along the xz plane. The wireless communication module 107 includes the multi-band antenna 106 of Embodiment 3, for example, active elements 64 and 65, a passive element 66 and a connector 67. The wireless communication module 107 may include a cover 68 that covers the active elements 64 and 65 and the passive element 66. The cover 68 is made of a metal, and functions as an electromagnetic shield or a heatsink or as both. Where there is no demand for the heat-radiating function, the active elements 64 and 65 and the passive element 66 may be encapsulated in a resin, instead of using the cover 68.

A conductor 61 and a via conductor 62, which form a wiring circuit pattern for connecting to the multi-band antenna 102' and the linear antenna 55 (which are denoted collectively by reference sign 60), are provided on the primary surface 40*b* side relative to the second ground conductor 32 of the dielectric 40 of the multi-band antenna 106. An electrode 63 is provided on the primary surface 40*b*. Components of the linear antenna 55 are not shown on the xz cross section of FIG. 18.

The active elements 64 and 65 include a DC/DC converter, a low noise amplifier (LNA), a power amplifier (PA), a high-frequency IC, etc., and the passive element 66 includes a capacitor, a coil, an RF switch, etc. The connector 67 is a connector for connecting between the wireless communication module 107 and the outside.

The active elements 64 and 65, the passive element 66 and the connector 67 are mounted on the primary surface 40*b* of the multi-band antenna 106 by being connected to the electrode 63 on the primary surface 40*b* of the dielectric 40 of the multi-band antenna 106 by solder, or the like. The wiring circuit including the conductor 61 and the via conductor 62, the active elements 64 and 65, the passive element 66 and the connector 67 together form a signal processing circuit, etc.

In the wireless communication module 107, the primary surface 40*a* where the multi-band antennas 102' and the linear antennas 55 are arranged close to each other is located on the opposite side from the primary surface 40*b* to which the active elements 64 and 65, etc., are connected. Thus, without being influenced by the active elements 64 and 65, etc., electromagnetic waves can be radiated from the multi-band antennas 102' and the linear antennas 55 and radio waves of the quasi-millimeter wave and millimeter wave bands can be received by the multi-band antennas 102' and the linear antennas 55. Therefore, it is possible to realize a small wireless communication module including antennas capable of selectively transmitting/receiving electromagnetic waves in two directions that are orthogonal to each other.

Figure 19:
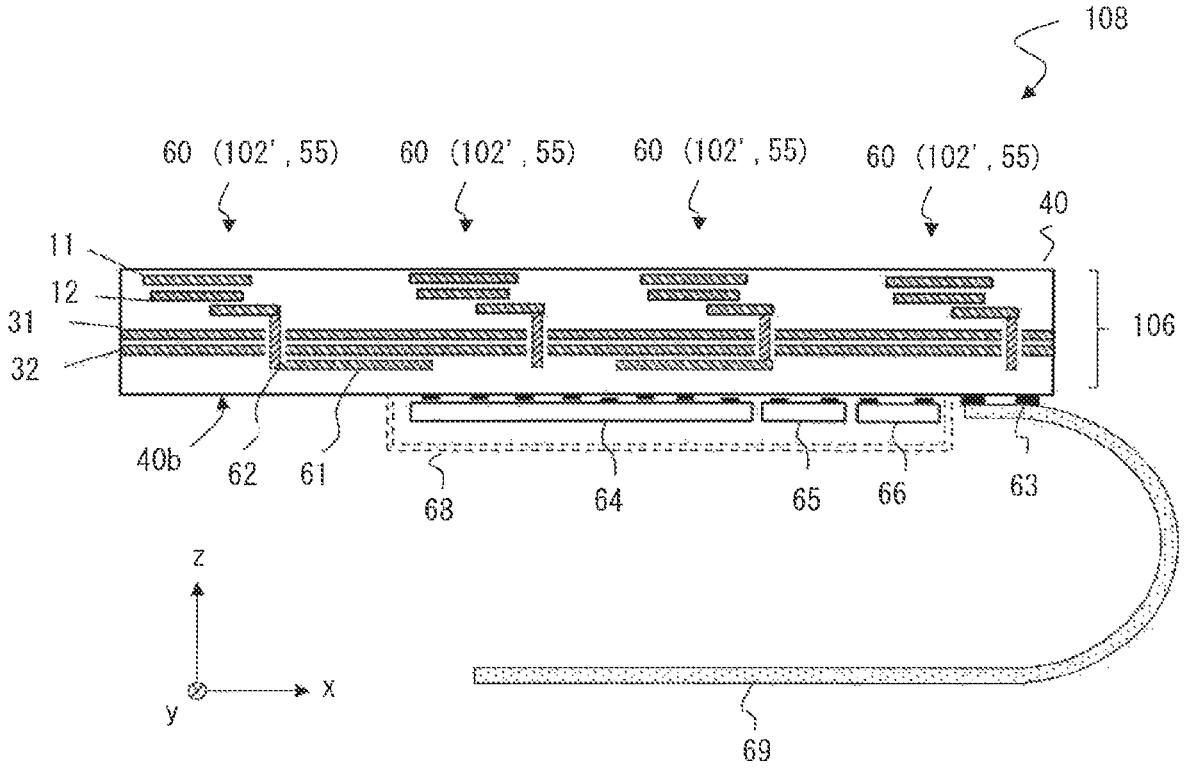
FIG. 19 is a schematic cross-sectional view showing another embodiment of a wireless communication module.

In a wireless communication module 108 shown in FIG. 19, the electrode 63 of the multi-band antenna 106 is electrically connected to a flexible wire 69. The flexible wire 69 may be a flexible printed circuit board on which a wiring circuit is formed, a coaxial cable, a liquid crystal polymer substrate, etc., for example. Particularly, a liquid crystal polymer has desirable high-frequency characteristics, and can suitably be used as a wiring circuit for the multi-band antenna 106.

Embodiment 7

Figure 20A:
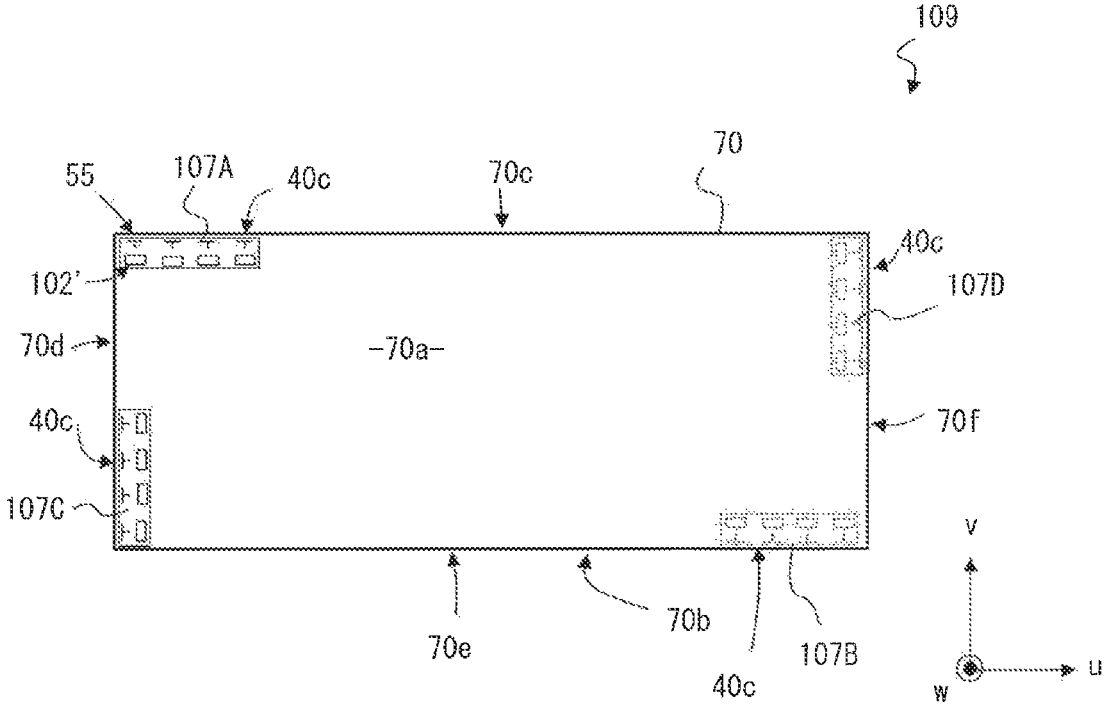
FIG. 20A is a schematic plan view showing an embodiment of a wireless communication device.
Figure 20B:
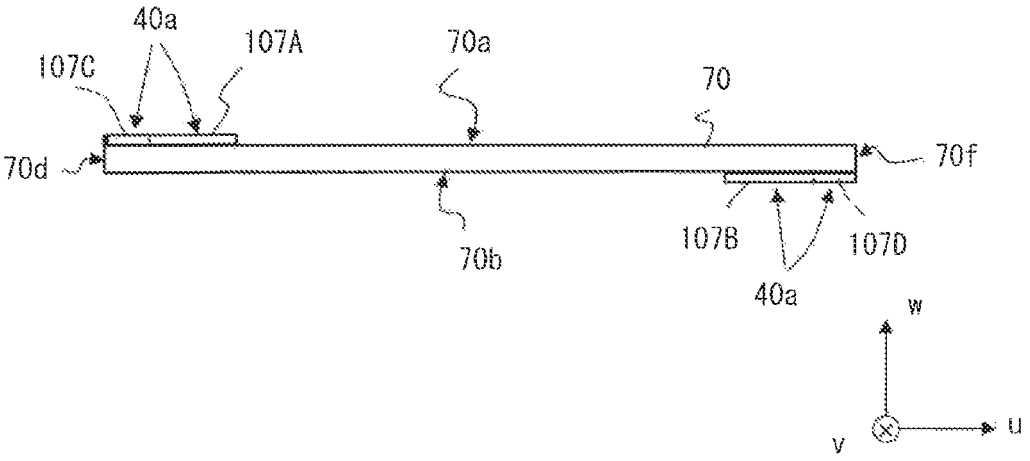
FIG. 20B is a schematic side view showing an embodiment of a wireless communication device.

An embodiment of a wireless communication device of the present disclosure will be described. FIG. 20A and FIG. 20B are a schematic plan view and a side view, respectively, showing a wireless communication device 109. The wireless communication device 109 includes a main board (circuit substrate) 70 and one or more wireless communication modules 107. In FIG. 13, the wireless communication device 109 includes four wireless communication modules 107A to 107D.

The main board 70 includes an electronic circuit needed to realize the function of the wireless communication device 109, and a wireless communication circuit, etc. The main board 70 may include a geomagnetic sensor, a GPS unit, and the like, for detecting the orientation and the location of the main board 70.

The main board 70 includes primary surfaces 70*a* and 70*b* and four side portions 70*c*, 70*d*, 70*e* and 70*f*. The primary surfaces 70*a* and 70*b* are perpendicular to the w axis in the second right-handed Cartesian coordinate system, the side portions 70*c* and 70*e* are perpendicular to the v axis, and the side portions 70*d* and 70*f* are perpendicular to the u axis. Although FIG. 20A schematically shows the main board 70 as a rectangular parallelepiped having a rectangular primary surface, the side portions 70*c*, 70*d*, 70*e* and 70*f* may each include a plurality of surfaces.

The wireless communication device 109 includes one or more wireless communication modules. The number of wireless communication modules may be adjusted based on the specifications of the wireless communication device and the demanded capabilities thereof, e.g., in which orientation electromagnetic waves are transmitted/received, the degree of sensitivity of transmission/reception, etc. The arrangement of wireless communication modules on the main board 70 may be determined while taking into consideration the electromagnetic interference with other wireless communication modules or other functional modules of the wireless communication device, and the sensitivity of transmission/reception of electromagnetic waves when the external cover of the wireless communication device is removed. When a wireless communication module is arranged on the primary surfaces 70*a* and 70*b* of the main board 70, it may be unlikely to interfere with other circuits, etc., provided on the main board 70 if the wireless communication module is located close to one of the side portions 70*c*, 70*d*, 70*e* and 70*f*. However, the position of the wireless communication module on the primary surfaces 70*a* and 70*b* is not limited to a position close to the side portions 70*c*, 70*d*, 70*e* and 70*f*, but may be at the center of the primary surfaces 70*a* and 70*b*, etc.

In the present embodiment, in the wireless communication device 109, the wireless communication modules 107A to 107D are arranged on the primary surface 70*a* or the primary surface 70*b* so that a side surface 40*c* of the dielectric 40 of the multi-band antenna 106 is located close to one of the side portions 70*c*, 70*d*, 70*e* and 70*f* and so that the primary surface 40*a* of the dielectric 40 is located on the opposite side from the main board 70. The side surface 40*c* of the dielectric 40 is located close to the linear radiation conductors 25 and 26 of the linear antenna 55, and electromagnetic waves are radiated from the side surface 40*c*. The primary surface 40*a* of the dielectric 40 is located close to the first radiation conductor 11 of the multi-band antenna 102, and electromagnetic waves are radiated from the primary surface 40*a*. Therefore, on the main board 70, the wireless communication modules 107A to 107D are positioned and oriented so that electromagnetic waves radiated from the wireless communication modules 107A to 107D are unlikely to interfere with the main board 70. The wireless communication modules 107A to 107D may be located close to each other or may be spaced apart from each other in the u, v and w directions.

For example, in the example shown in FIG. 20A and FIG. 20B, the wireless communication modules 107A and 107C are arranged on the primary surface 70*a* so that the side surfaces 40*c* of the wireless communication modules 107A and 107C are each located close to one of the side portions 70*c* and 70*d*. The wireless communication modules 107B and 107D are arranged on the primary surface 70*b* so that the side surfaces 40*c* of the wireless communication modules 107B and 107D are each located close to one of the side portions 70*e* and 70*f*. In the present embodiment, the side surface 40*c* of the wireless communication module 107A is located close to the side portion 70*c*, and the side surface 40*c* of the wireless communication module 107B is located close to the side portion 70*e*. The side surface 40*c* of the wireless communication module 107C is located close to the side portion 70*d*, and the side surface 40*c* of the wireless communication module 107D is located close to the side portion 70*f*. The wireless communication modules 107A to 107D are arranged in point symmetry with each other relative to the center of the main board 70.

Table 3 shows the direction of the maximum intensity in the distribution of the electromagnetic waves radiated from the multi-band antennas 102 and the linear antennas 55 of the wireless communication modules 107A to 107D arranged as described above.

TABLE 3

| Wireless communication module | Radiation direction of multiband antenna 102' | Radiation direction of linear antenna 55 |
|---|---|---|
| 107A | +w | +v |
| 107B | −w | −v |
| 107C | +w | −u |
| 107D | −w | +u |

Thus, electromagnetic waves can be radiated in all directions (the ±u, ±v and ±w directions) relative to the main board 70. For example, the GPS unit of the wireless communication device 109 can be used to detect locations, and to determine the closest one of a plurality of base stations that are located around the wireless communication device 109 and whose location information is known and determine the direction of that base station from the wireless communication device 109. The geomagnetic sensor of the wireless communication device 109 can be used to determine the orientation of the wireless communication device 109, and to determine one of the wireless communication modules 107A to 107D and the multi-band antenna 102'/the linear antenna 55 that can, in the current orientation of the wireless communication device 109, radiate an electromagnetic wave with the highest intensity to the base station determined to communicate with. Thus, it is possible to realize communication with high quality by transmitting/receiving electromagnetic waves by using the determined wireless communication module and antenna.

Figure 21A:
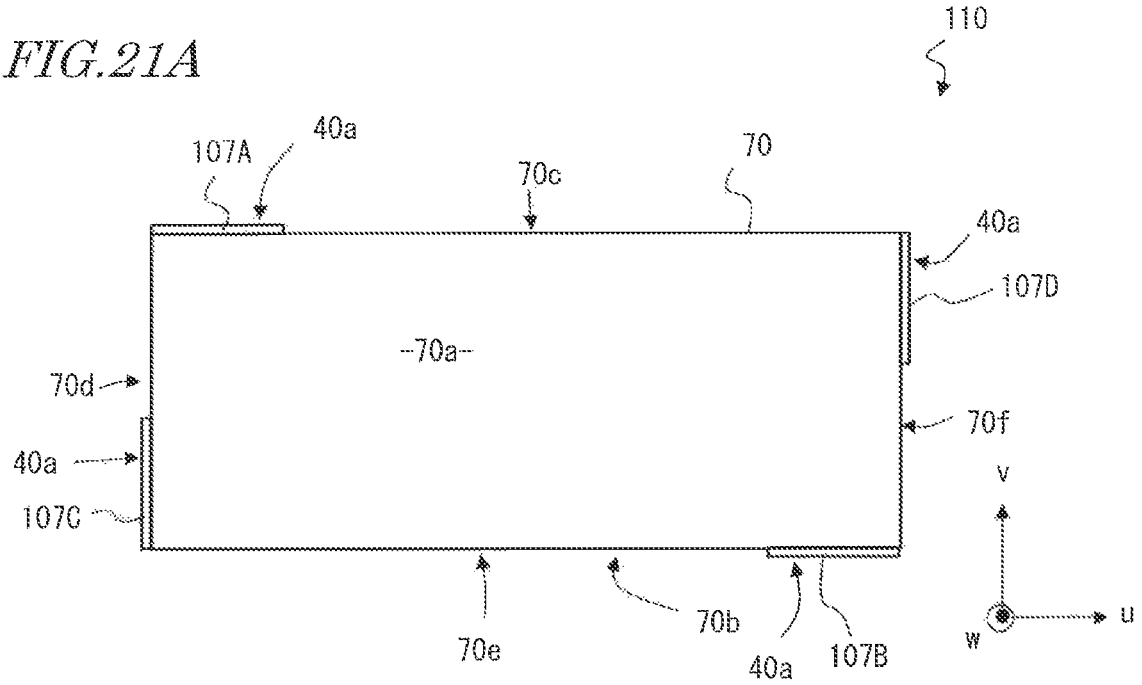
FIG. 21A is a schematic plan view showing another embodiment of a wireless communication device.
Figure 21B:
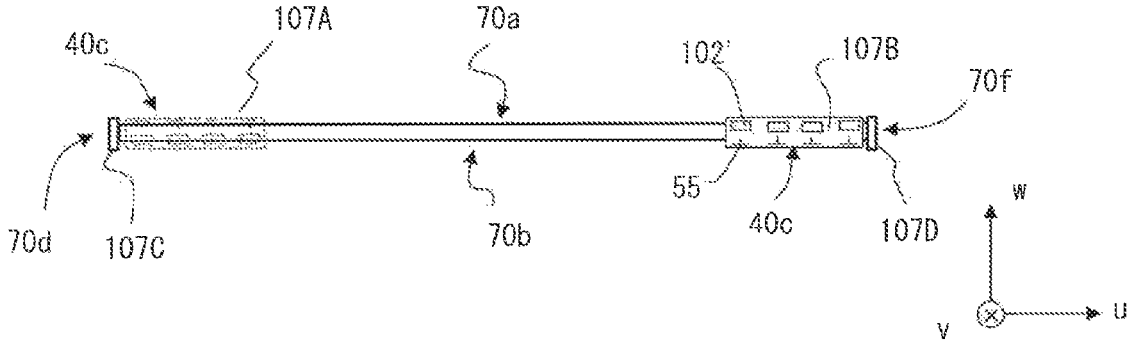
FIG. 21B is a schematic side view showing another embodiment of a wireless communication device.
Figure 21C:
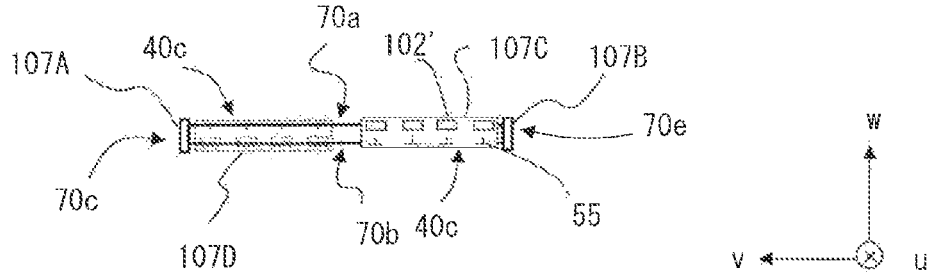
FIG. 21C is a schematic side view showing another embodiment of a wireless communication device.

The wireless communication modules 107A to 107D may be arranged on the side portion of the main board 70. FIGS. 21A to 21C are a schematic plan view and side views, respectively, showing a wireless communication device 110. In the wireless communication device 110, the wireless communication modules 107A to 107D are arranged on the side portions 70*c* to 70*f* so that the side surface 40*c* of the dielectric 40 of the multi-band antenna 106 is located close to the primary surface 70*a* or the primary surface 70*b*, and the primary surface 40*a* of the dielectric 40 is located on the opposite side from the main board 70.

In the example shown in FIGS. 21A to 21C, the wireless communication modules 107A and 107B are arranged on the side portions 70*c* and 70*e* so that the side surfaces 40*c* of the wireless communication modules 107A and 107B are each located close to one of the primary surfaces 70*a* and 70*b*. The wireless communication modules 107C and 107D are arranged on the side portions 70*d* and 70*f* so that the side surfaces 40*c* of the wireless communication modules 107C and 107D are each located close to one of the primary surfaces 70*a* and 70*b*. In the present embodiment, the side surface 40*c* of the wireless communication module 107A is located close to the primary surface 70*a*, and the side surface 40*c* of the wireless communication module 107B is located close to the primary surface 70*b*. The side surface 40*c* of the wireless communication module 107C is located close to the primary surface 70*a*, and the side surface 40*c* of the wireless communication module 107D is located close to the primary surface 70*b*. The wireless communication modules 107A to 107D are arranged in point symmetry with each other relative to the center of the main board 70. The positions of the wireless communication modules 107A to 107D in the w-axis direction may be not aligned with the center of the main board 70 in the w-axis direction. The wireless communication modules 107A to 107D may be arranged in contact with, or spaced apart from, the side portions 70*c* to 70*f* of the main board 70.

Table 4 shows the direction of the maximum intensity in the distribution of the electromagnetic waves radiated from the multi-band antenna 102' and the linear antenna 55 of the wireless communication modules 107A to 107D arranged as described above.

TABLE 4

| Wireless communication module | Radiation direction of multiband antenna 102' | Radiation direction of linear antenna 55 |
|---|---|---|
| 107A | +v | +w |
| 107B | −v | −w |
| 107C | −u | −w |
| 107D | +u | +w |

Thus, also with the arrangement shown in FIGS. 21A to 21C, the wireless communication device 110 can radiate electromagnetic waves in all directions (the ±u, ±v and ±w directions) relative to the main board 70.

The arrangement of wireless communication modules 107 in the wireless communication device is not limited to the embodiment described above, but various modifications can be made thereto. For example, some of a plurality of wireless modules may be arranged on at least one of the primary surfaces 70*a* and 70*b* of the main board 70, with the remaining wireless modules being arranged on at least one of the side portions 70*c*, 70*d*, 70*e* and 70*f*.

Alternative Embodiments

The features of the multi-band antennas described above in Embodiments 1 to 7 can be combined with one another. The number of planar antennas of a multi-band antenna is not limited to the values shown in the embodiments above.

The multi-band antenna of the present disclosure is applicable to various antennas for high-frequency wireless communication and various wireless communication circuits including the same, and particularly to wireless communication devices for quasi-microwave, centimeter wave, quasi-millimeter wave and millimeter wave bands.

While certain embodiments of the present invention has been described above, it will be apparent to those skilled in the art that the invention may be modified in numerous ways and may assume many embodiments other than those specifically described above. Accordingly, it is intended by the appended claims to cover all modifications of the invention that fall within the spirit and scope of the invention.

What is claimed is:

1. A multi-band antenna capable of transmitting/receiving electromagnetic waves at least in a first wavelength band of a first center wavelength λ1 and a second wavelength band of a second center wavelength λ2, which is shorter than the first center wavelength λ1, the multi-band antenna comprising at least one antenna unit, wherein the at least one antenna unit includes:

a first radiation conductor; and a first ground conductor spaced apart from the first radiation conductor with a dielectric having a relative dielectric constant εr interposed therebetween;

a second radiation conductor;

a second ground conductor; and a first strip conductor, wherein:

the first radiation conductor and the first ground conductor each have a planar shape having a pair of opposing first sides; and a distance Lrf1 between the pair of opposing first sides of the first radiation conductor and a distance Lg1 between the pair of opposing sides of the first ground conductor satisfy expressions below:

$$0.2\lambda 1/\varepsilon r^{1/2} \leq Lrf1 \leq 0.7\lambda 1/\varepsilon r^{1/2}; \text{ and}$$

$$0.7\lambda 2/\varepsilon r^{1/2} \leq Lg1 \leq 1.75\lambda 2/\varepsilon r^{1/2},$$

wherein a hole defined through the second ground conductor, wherein a feed conductor provided extending through the hole of the second ground conductor and having one end connected to the first strip conductor, and wherein a plurality of first via conductors arranged so as to sandwich or surround the feed conductor as seen from above, and the first via conductors connect together the first ground conductor and the second ground conductor.

2. The multi-band antenna according to claim 1, wherein the second radiation conductor arranged between the first radiation conductor and the first ground conductor.

3. The multi-band antenna according to claim 2, wherein:

the second radiation conductor has a planar shape having a pair of opposing first sides;

a distance Lrs1 between the pair of opposing sides of the second radiation conductor satisfies an expression below:

$$0.2\lambda 1/\varepsilon r^{1/2} \leq Lrs1 \leq 0.5\lambda 1/\varepsilon r^{1/2}.$$

4. The multi-band antenna according to claim 3, wherein:

the second radiation conductor has a rectangular shape having the pair of opposing first sides and the pair of opposing second sides; and a distance Lrs2 between the pair of opposing second sides of the second radiation conductor satisfies an expression below:

$$0.2\lambda 1/\varepsilon r^{1/2} \leq Lrs2 \leq 0.7\lambda 1/\varepsilon r^{1/2}.$$

5. The multi-band antenna according to claim 2, wherein the first strip conductor arranged between the first radiation conductor and the first ground conductor or between the second radiation conductor and the first ground conductor, for feeding the first and second radiation conductors.

6. The multi-band antenna according to claim 5, further comprising:

a second strip conductor arranged between the first radiation conductor and the first ground conductor or between the second radiation conductor and the first ground conductor, for feeding the first and second radiation conductors, wherein the first strip conductor and the second strip conductor extend in directions that are orthogonal to each other.

7. The multi-band antenna according to claim 5, wherein the second ground conductor arranged on an opposite side from the first radiation conductor relative to the first ground conductor, wherein the second ground conductor encompasses the first ground conductor within an outer edges of itself as seen from above.

8. The multi-band antenna according to claim 7, wherein the first ground conductor and the second ground conductor are electrically connected to each other.

9. The multi-band antenna according to claim 8, wherein:

the at least one antenna unit includes a plurality of second via conductors that connect together the first ground conductor and the second ground conductor; and the plurality of second via conductors are arranged along at least a portion of a periphery of the first ground conductor and overlap with the second ground conductor as seen from above.

10. The multi-band antenna according to claim 7, comprising a plurality of antenna units, wherein:

the antenna units are arranged along a first direction; and the second ground conductor of each of the antenna units is connected to the second ground conductor of an adjacent antenna unit.

11. The multi-band antenna according to claim 10, wherein in each of the antenna units, the pair of first sides of the first radiation conductor and the pair of first sides of the first ground conductor are arranged at an angle of 45° or −45° relative to the first direction as seen from above.

12. The multi-band antenna according to claim 11, wherein the first ground conductor of each of the antenna units is connected to the first ground conductor of an adjacent antenna unit.

13. The multi-band antenna according to claim 11, wherein the first ground conductor of each of the antenna units is separate from the first ground conductor of an adjacent antenna unit.

14. The multi-band antenna according to claim 1, wherein:

the first radiation conductor has a rectangular shape having the pair of opposing first sides and the pair of opposing second sides; and a distance Lrf2 between the pair of opposing second sides of the first radiation conductor satisfies an expression below:

$$0.2\lambda 1/\varepsilon r^{1/2} \leq Lrf2 \leq 0.7\lambda 1/\varepsilon r^{1/2}.$$

15. The multi-band antenna according to claim 1, wherein:

the planar shape of the first ground conductor further has a pair of opposing second sides; and a distance Lg2 between the pair of opposing second sides of the first ground conductor satisfies an expression below:

$$0.7\lambda 2/\varepsilon r^{1/2} \leq Lg2 \leq 1.75\lambda 2/\varepsilon r^{1/2}.$$

16. The multi-band antenna according to claim 1, comprising a plurality of antenna units, wherein the antenna units are arranged along a first direction.

* * * * *